US009408511B2

(12) United States Patent
Vanderlinden

(10) Patent No.: US 9,408,511 B2
(45) Date of Patent: Aug. 9, 2016

(54) PICK-UP HEAD SYSTEM HAVING A HORIZONTAL SEALED DEBRIS DOOR FOR A MOBILE SWEEPING VEHICLE

(76) Inventor: Roger P. Vanderlinden, Burlington (CA)

( * ) Notice: Subject to any disclaimer, the term of this patent is extended or adjusted under 35 U.S.C. 154(b) by 748 days.

(21) Appl. No.: 13/495,806

(22) Filed: Jun. 13, 2012

(65) Prior Publication Data

US 2013/0185894 A1 Jul. 25, 2013

Related U.S. Application Data

(60) Provisional application No. 61/496,410, filed on Jun. 13, 2011.

(51) Int. Cl.

| | |
|---|---|
| ***A47L 5/12*** | (2006.01) |
| ***A47L 9/02*** | (2006.01) |
| ***E01H 1/08*** | (2006.01) |
| ***A47L 11/40*** | (2006.01) |

(52) U.S. Cl.

CPC ..... *A47L 9/02* (2013.01); *A47L 11/4044* (2013.01); *E01H 1/08* (2013.01); *E01H 1/0827* (2013.01); *E01H 1/0836* (2013.01); *E01H 1/0845* (2013.01); *E01H 1/0872* (2013.01)

(58) Field of Classification Search

CPC ..... A47L 9/02; A47L 11/4044; E01H 1/0836; E01H 1/08; E01H 1/0872; E01H 1/0845; E01H 1/0827

USPC ..... 15/340.1, 340.3

IPC ..... A47L 5/12

See application file for complete search history.

(56) References Cited

U.S. PATENT DOCUMENTS

| | | | | |
|---|---|---|---|---|
| 6,584,640 | B2 * | 7/2003 | Vanderlinden | 15/418 |
| 2013/0019429 | A1 * | 1/2013 | Vanderlinden | 15/246 |

* cited by examiner

*Primary Examiner* — David Redding

(57) ABSTRACT

A pick-up head system for use with a surface cleaning vehicle comprises a housing with a debris receiving main inlet and a debris outlet. A rotatable door assembly is mounted on the housing at the debris receiving main inlet for rotation about a substantially horizontally oriented door pivot axis, for controlling the passage of debris through the debris receiving main inlet. In use, as the rotatable door assembly rotates about the horizontally oriented door pivot axis to thereby permit debris to enter the housing through the debris receiving main inlet. An air flow barrier disposed between the rotatable door assembly and the housing substantially precludes the passage of air and small debris between the rotatable door assembly and the housing.

35 Claims, 21 Drawing Sheets

PICK-UP HEAD SYSTEM HAVING A HORIZONTAL SEALED DEBRIS DOOR FOR A MOBILE SWEEPING VEHICLE

RELATED APPLICATIONS

This application is a non-provisional application claiming priority from U.S. Provisional Patent Application Ser. No. 61/496,410 filed on Jun. 13, 2011, which is herein incorporated by reference.

FIELD OF THE INVENTION

The present invention relates to dustless pick-up head systems for factory, sidewalk and street sweepers, and more particularly to such dustless pick-up head systems that readily maintain full suctioning effectiveness under almost all conditions.

BACKGROUND OF THE INVENTION

It is known in the prior art to have a substantially sealed rotatable door apparatus on a pick-up head for use with a surface cleaning vehicle, wherein the rotatable door apparatus rotates about a vertical axis. It has been found that with this type of configuration, the effective size of the debris receiving opening whereat the substantially sealed door apparatus is mounted, cannot be less than one-quarter of the width of the pick-up head, inclusive of the size of the substantially sealed rotatable door apparatus.

It is an object of the present invention to provide a full-width dustless pick-up head system.

It is another object of the present invention to provide a pick-up head system wherein the effective size of the debris receiving opening whereat the substantially sealed rotatable door apparatus is mounted, can be more than about one-quarter the width of the pick-up head.

It is another object of the present invention to provide a pick-up head system wherein the effective size of the debris receiving opening whereat the substantially sealed door apparatus is mounted, can be the full width of the pick-up head.

SUMMARY OF THE INVENTION

In accordance with one aspect of the present invention there is disclosed a novel pick-up head system for use with a surface cleaning vehicle having a fore-aft axis of travel. The pick-up head system comprises a housing having an interior and a suctioning bottom opening defined by a bottom peripheral edge and open in fluid communication and debris transfer relation to the interior, and defining a fore-aft axis; a debris receiving main inlet in the housing, disposed in debris receiving relation with respect to a surface being cleaned, for receiving debris to the housing, and disposed in debris transfer relation to the interior of the housing for receiving debris to the housing; a rotatable door assembly mounted on the housing at the debris receiving main inlet for rotation about a substantially horizontally oriented door pivot axis, for controlling the passage of debris through the debris receiving main inlet; an air flow barrier operatively disposed between the rotatable door assembly and the housing to substantially preclude the passage of air and small debris between the rotatable door assembly and the housing; and a debris outlet in the housing; wherein, in use, as the rotatable door assembly rotates about the horizontally oriented door pivot axis to thereby permit debris to enter the housing through the debris receiving main inlet, the air flow barrier substantially preclude the passage of air and small debris between the rotatable door assembly and the housing.

In accordance with another aspect of the present invention there is disclosed a novel sealed door apparatus for use with a dustless pick-up head on a surface cleaning vehicle. The sealed door apparatus comprises a door frame surrounding the debris receiving main inlet; a rotatable door assembly mounted on the housing at the door frame for rotation about a substantially horizontally oriented door pivot axis; and an air flow barrier operatively disposed between the rotatable door assembly and the door frame to substantially preclude the passage of air and small debris between the rotatable door assembly and the door frame.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the pick-up head system according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF THE PREFERRED EMBODIMENTS

Figure 1:
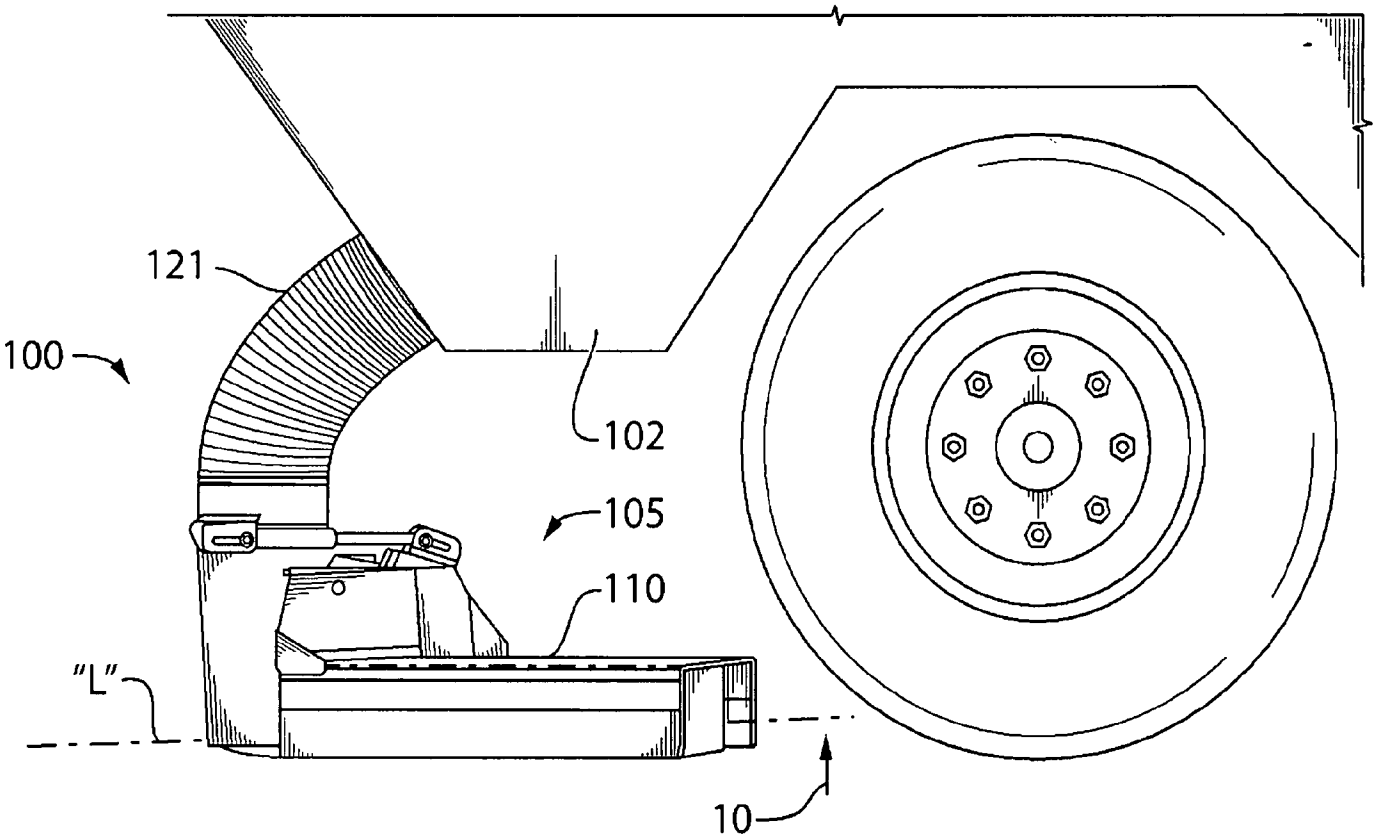
FIG. 1A is a perspective view of the first preferred embodiment of the pick-up head system according to the present invention mounted on a surface cleaning vehicle.
FIG. 1B is a partially cut-away top plan view of the first preferred embodiment pick-up head system of FIG. 1A.
FIG. 1C is a front elevational view of the first preferred embodiment pick-up head system of FIG. 1A.
FIG. 1D is a left corner elevational view of the first preferred embodiment pick-up head system of FIG. 1A.
FIG. 1E is a side perspective view from underneath of the first preferred embodiment pick-up head system of FIG. 1A.
FIG. 1F is a front perspective view from above of the first preferred embodiment pick-up head system of FIG. 1A.
FIG. 1G is a front perspective view from the right side of the first preferred embodiment pick-up head system of FIG. 1A.
FIG. 1H is a front perspective view from the right side of the first preferred embodiment pick-up head system of FIG. 1, and similar to FIG. 7 except that the raisable and lowerable sealed door assembly is in a raised position.
FIG. 1I is a front perspective view from slightly off-centre to the right of the first preferred embodiment pick-up head system of FIG. 1A.
FIG. 1J is a front perspective view from slightly off-centre to the right of the first preferred embodiment pick-up head system of FIG. 1, and similar to FIG. 9 except that the raisable and lowerable sealed door assembly is in a lowered surface engaging position.
FIG. 1K is a bottom plan view of the first preferred embodiment pick-up head system of FIG. 1A.
FIG. 1L is an enlarged partial view of the first preferred embodiment pick-up head system of FIG. 1A.
FIG. 1M is an enlarged sectional side elevational view of the first preferred embodiment pick-up head system of FIG. 1A.
FIG. 1N is an enlarged partial view of a first alternative embodiment of the first preferred embodiment pick-up head system of FIG. 1A with the raisable and lowerable sealed door assembly in raised position.
Figure 1A:
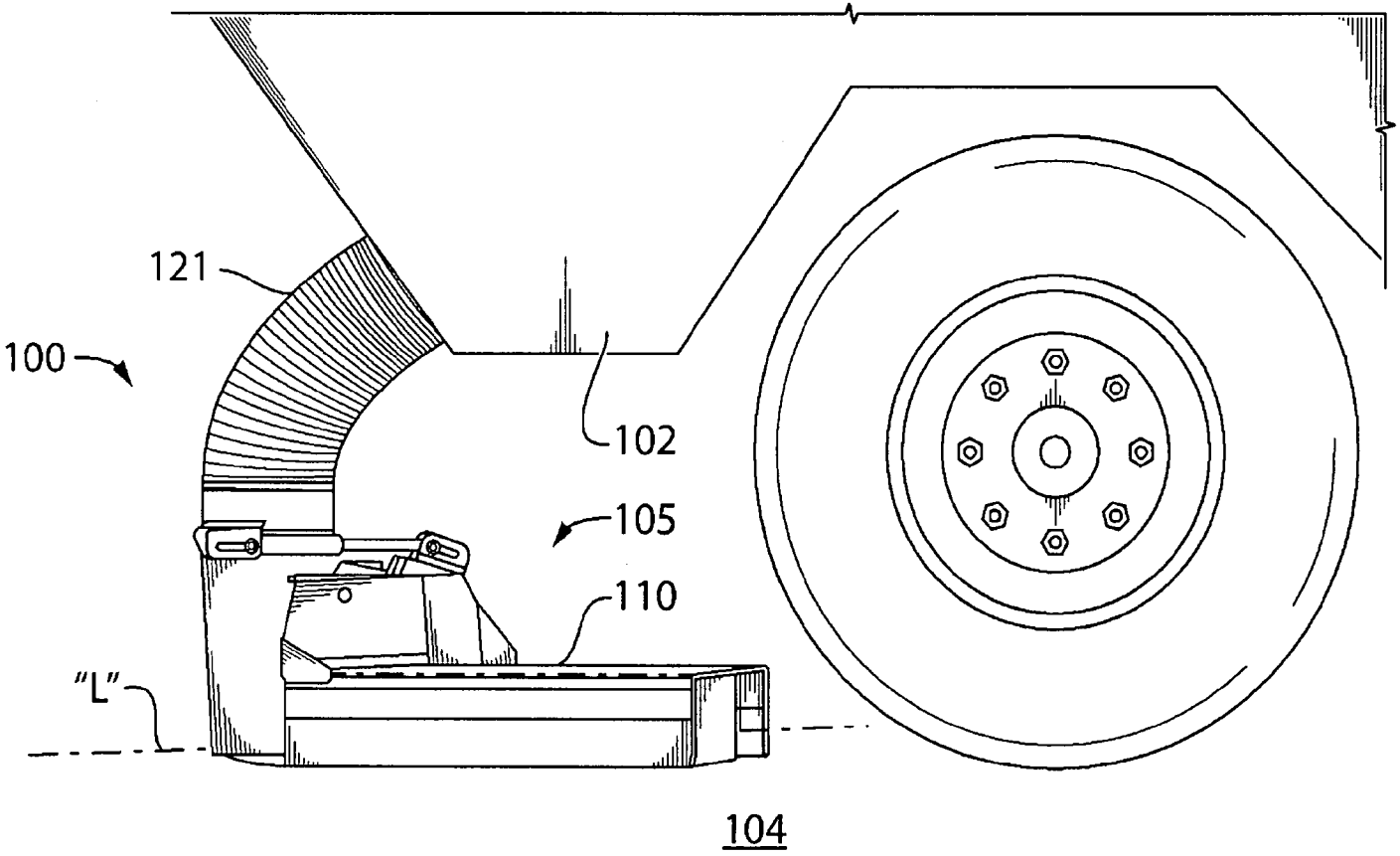
Figure 1B:
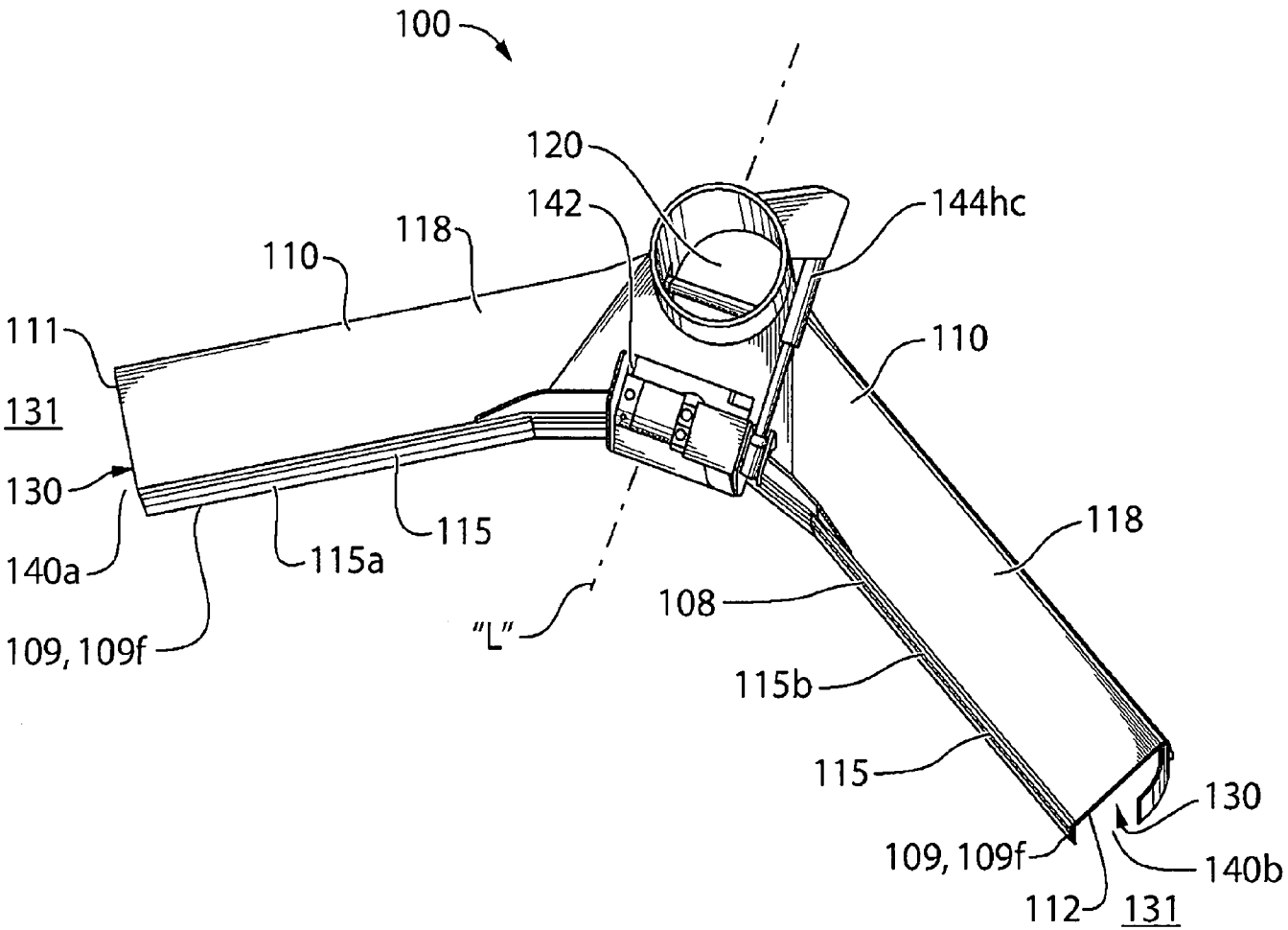
Figure 1C:
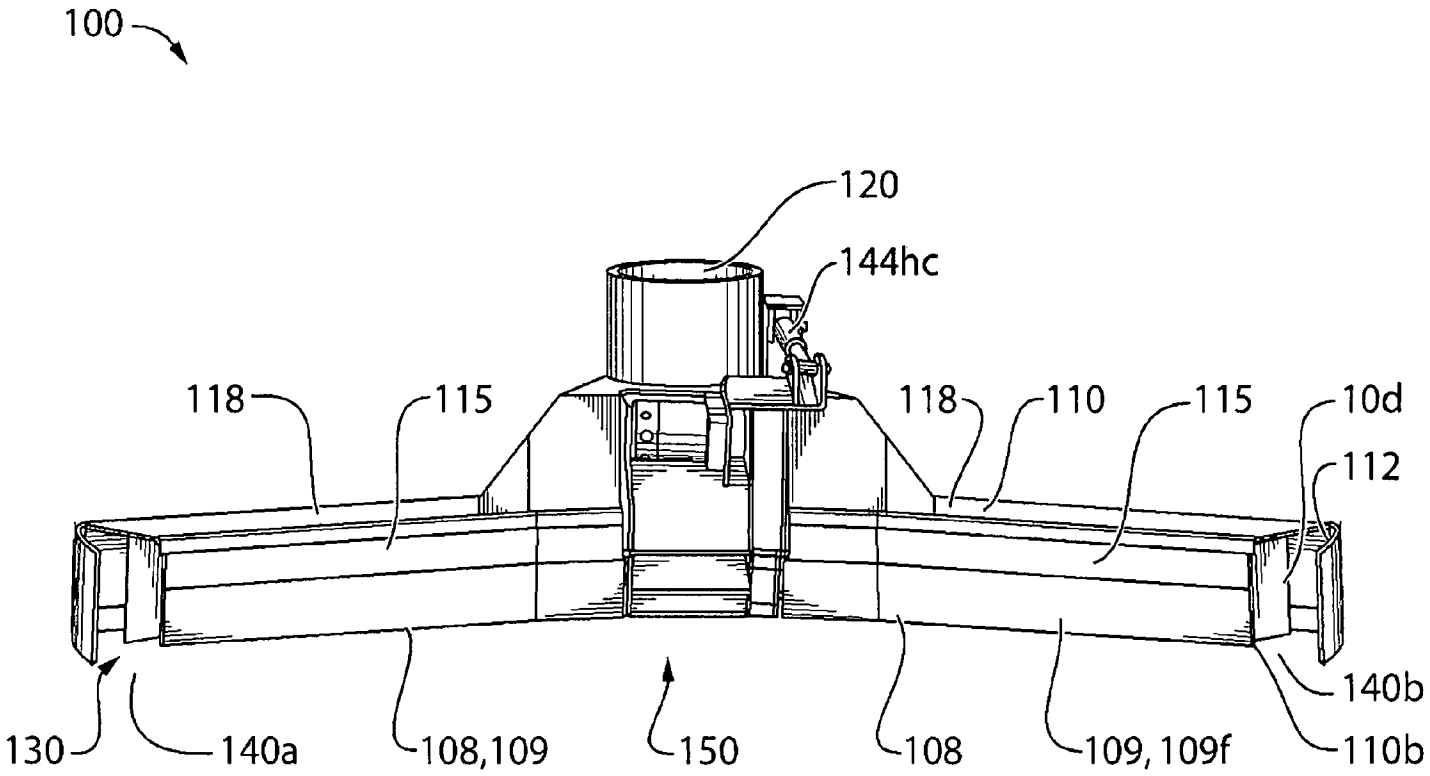
Figure 1D:
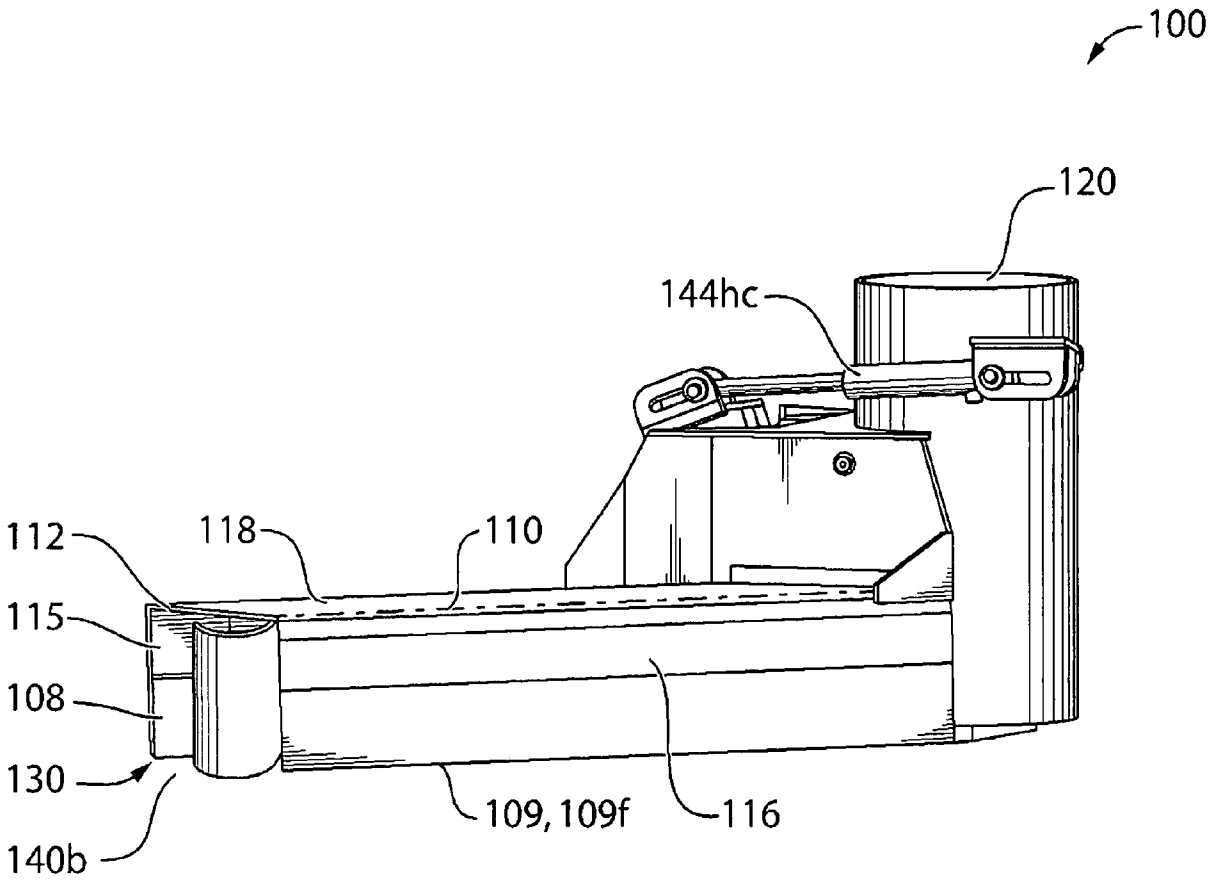
Figure 1E:
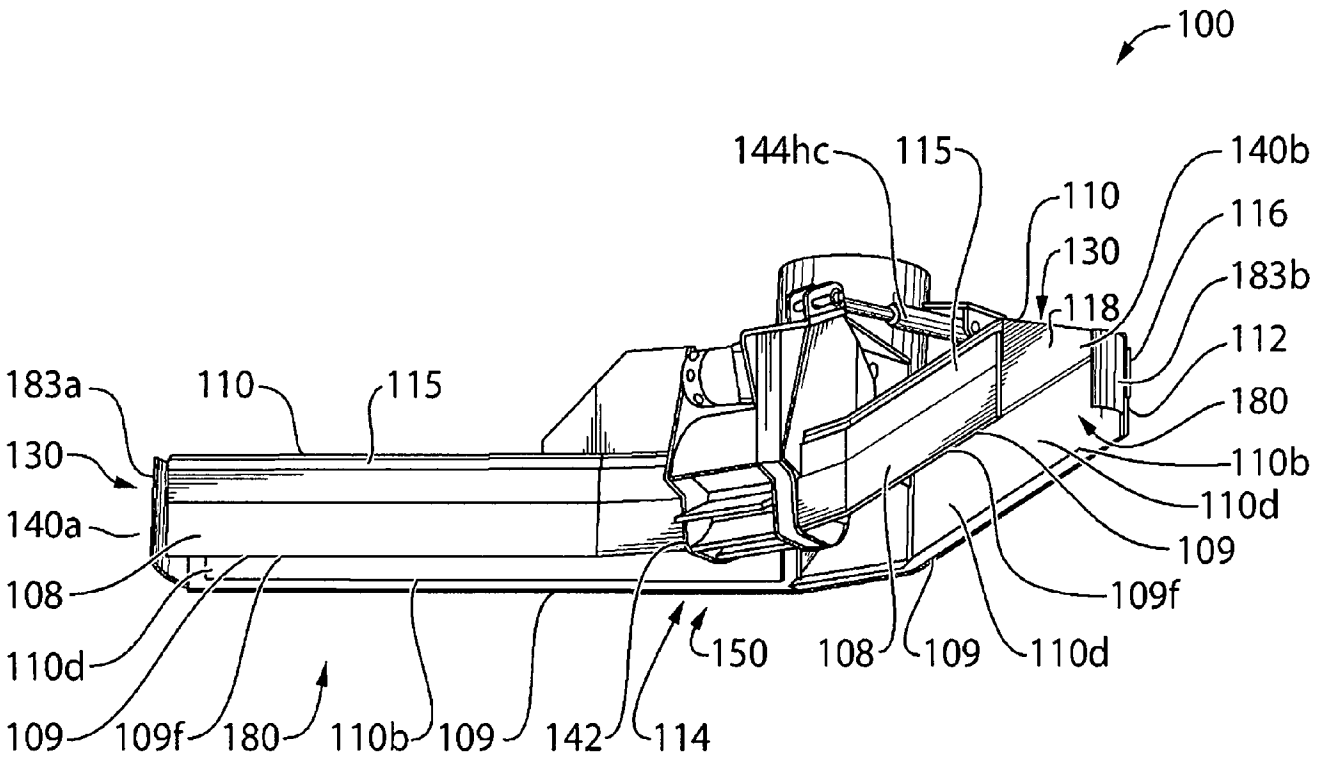
Figure 1F:
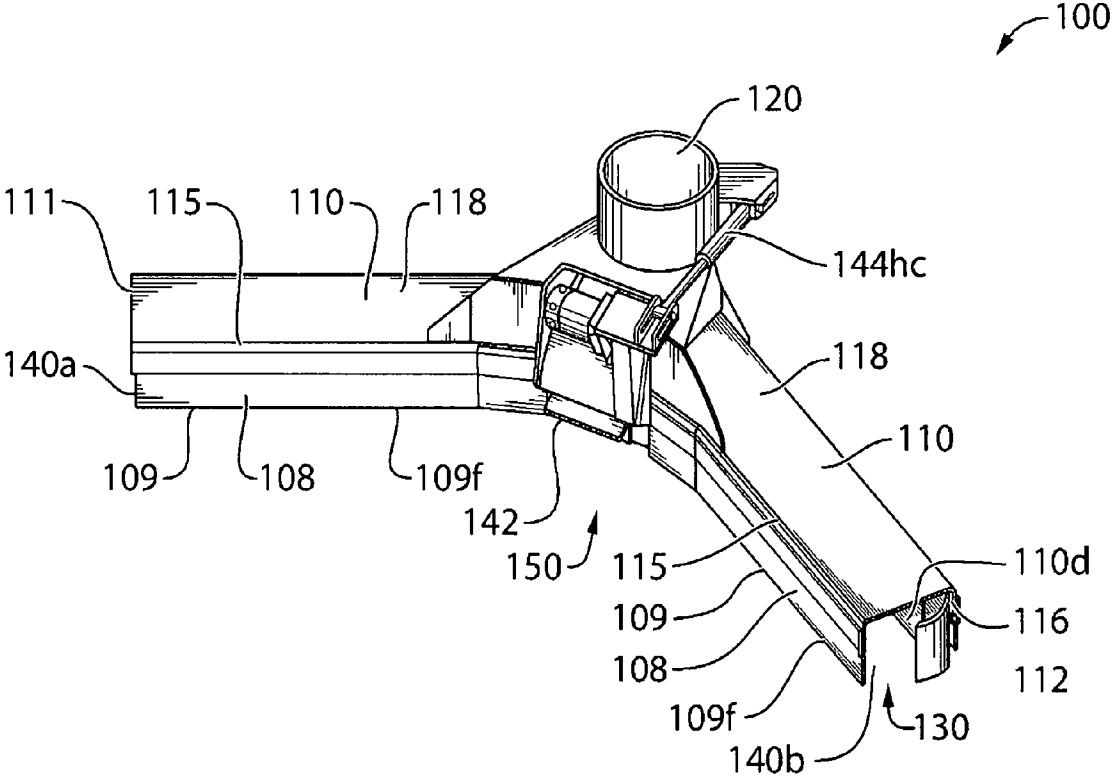
Figure 1G:
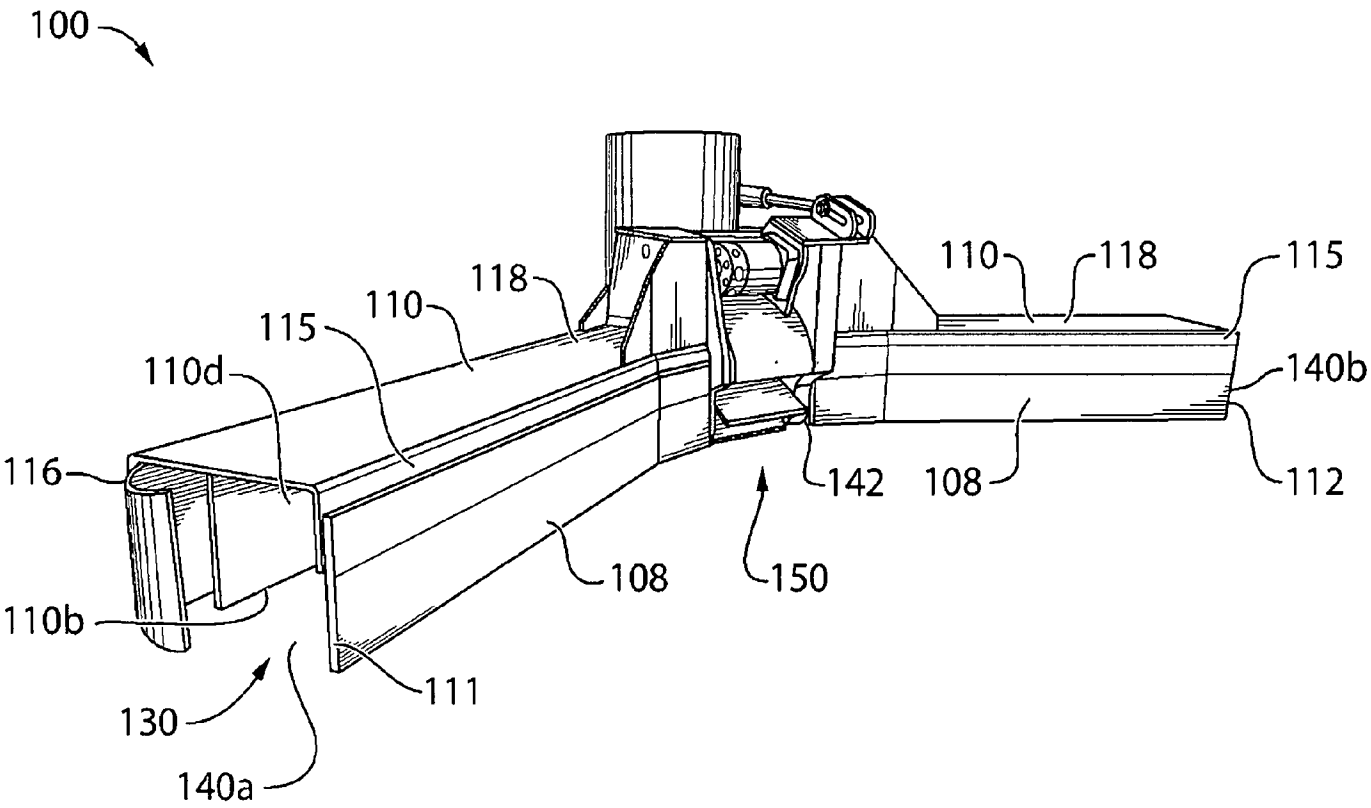
Figure 1H:
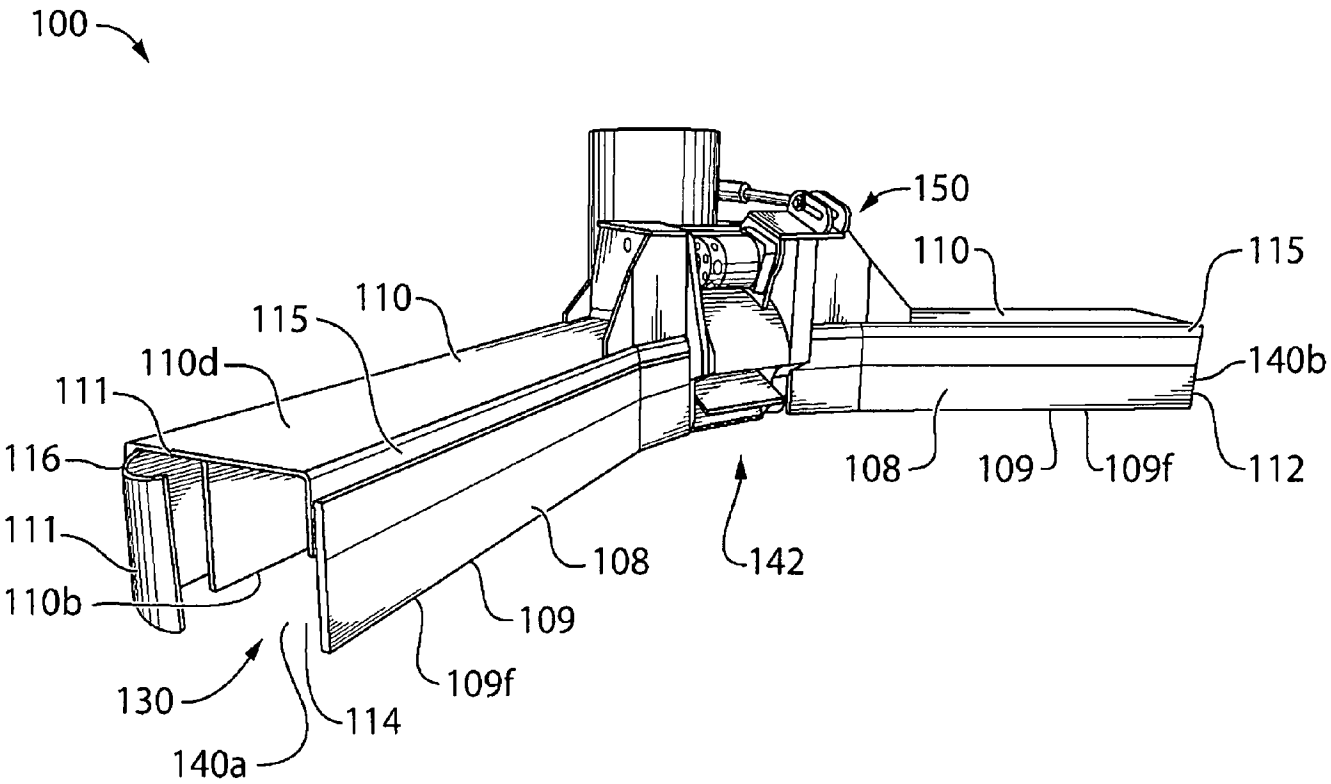
Figure 1I:
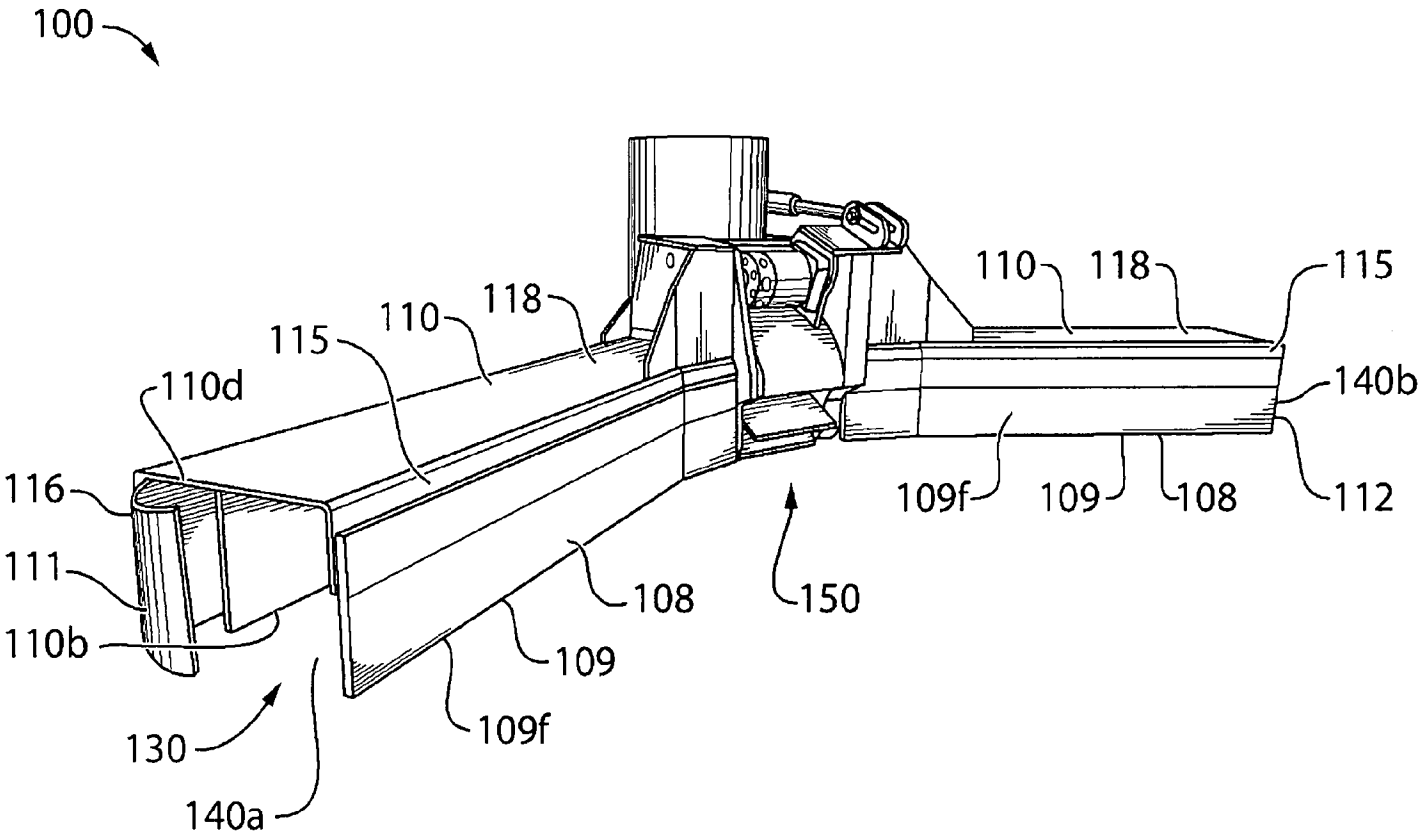
Figure 1J:
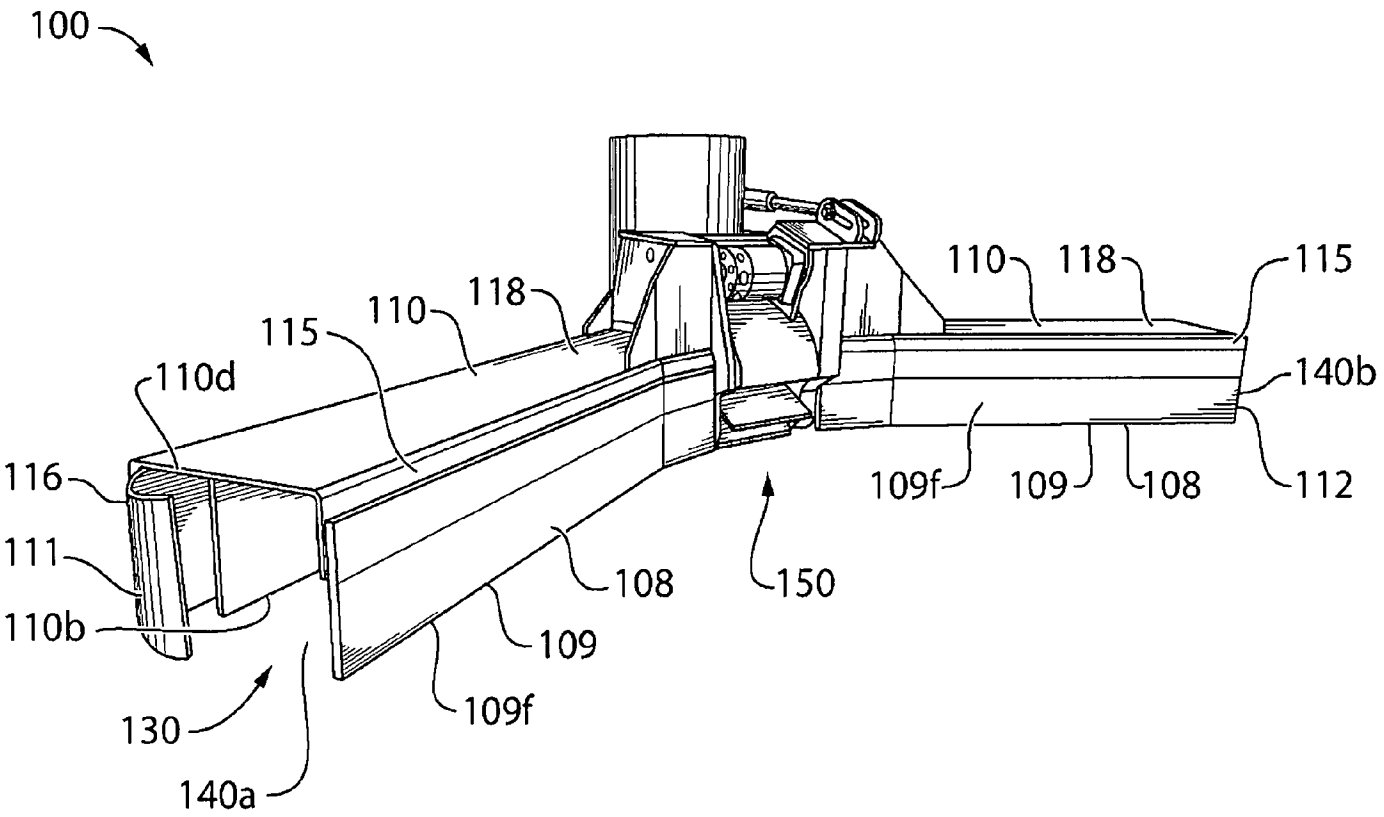
Figure 1K:
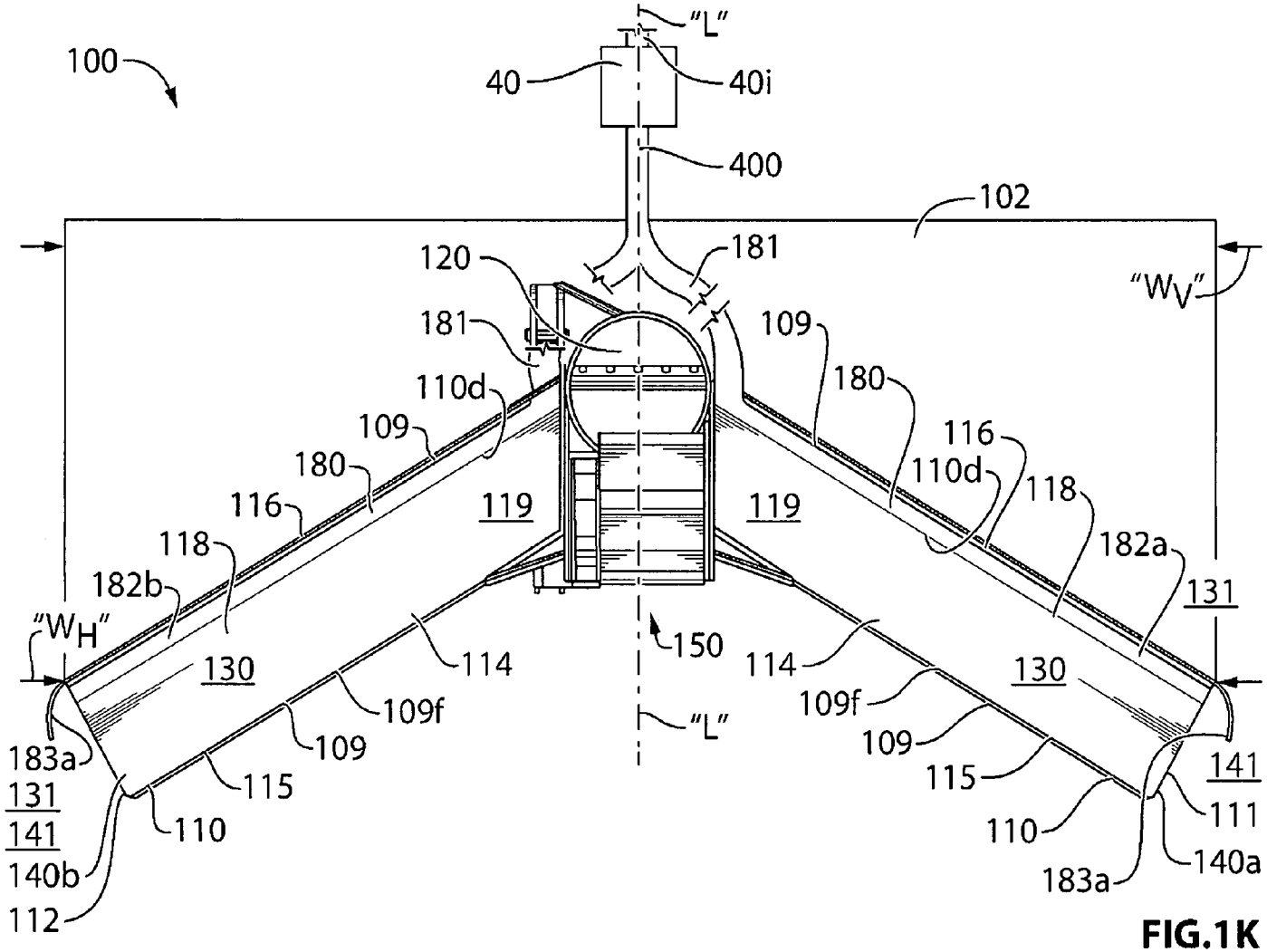
Figure 1L:
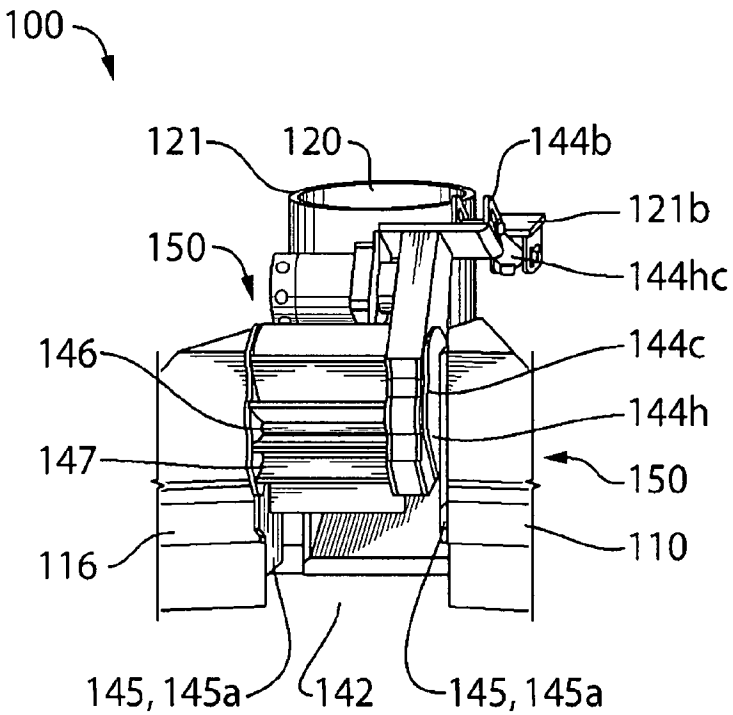
Figure 1M:
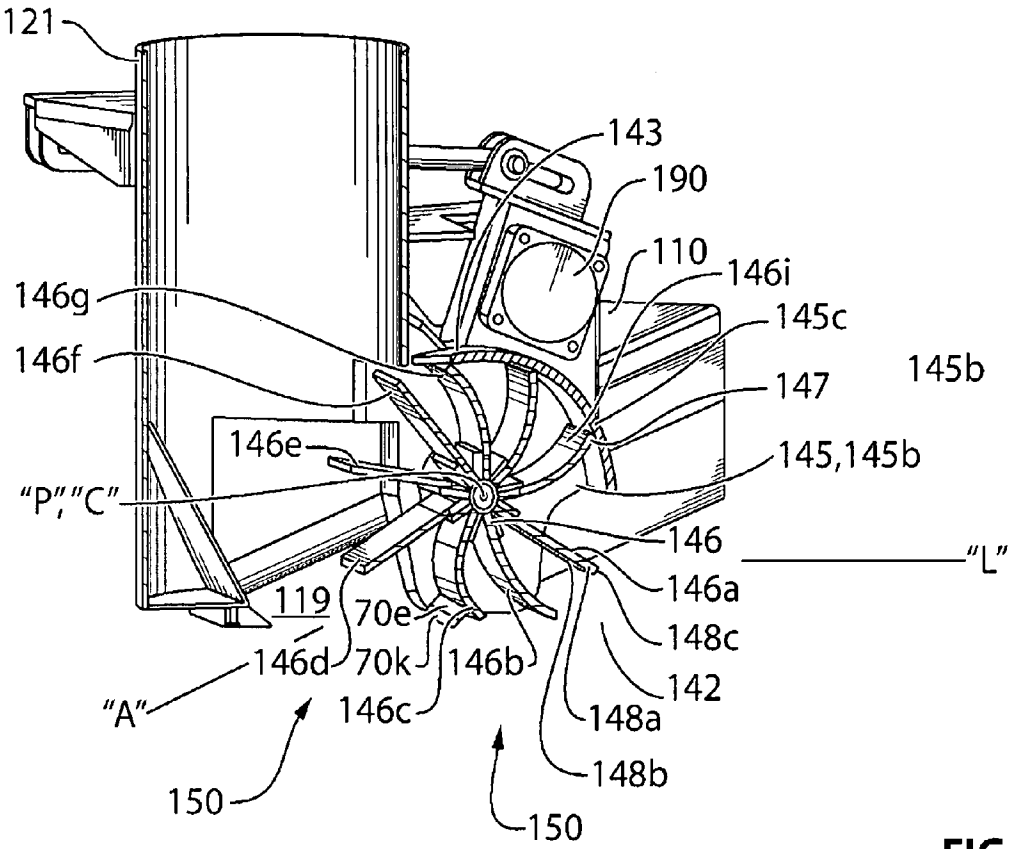
Figure 1N:
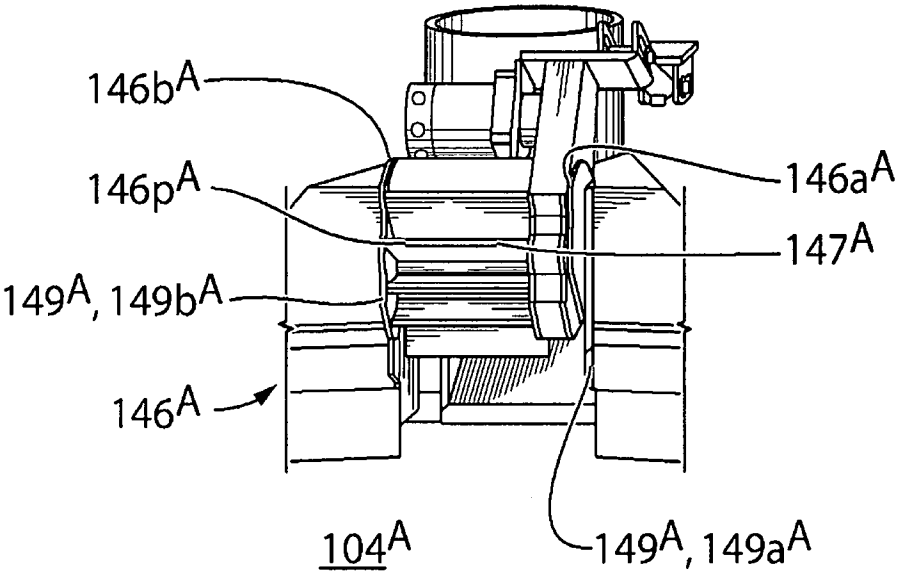

Reference will now be made to FIGS. 1A through 1N, which show a first preferred embodiment of the pick-up head system of the present invention, as indicated by general reference numeral 100. The pick-up head system 100 is for use with a surface cleaning vehicle 102 for removing dust (including fine particulate matter) and debris (including bottles, cans, leaves, dirt, and so on) from a surface to be cleaned 104.

The first preferred embodiment pick-up head system 100 is for use with a surface cleaning vehicle 102 having a main fan (not specifically shown), and defining a width "$W_V$" (see FIG. 1K) and a generally central fore-aft longitudinal axis of travel "L", for cleaning a surface to be cleaned 104 and basically comprises a housing 110, a substantially rigid debris deflecting skirt 108, a first debris suctioning inlet 140*a*, a debris outlet 120, a substantially hollow interior 119, a debris passage 130, and an air supply passage 180 within the housing 110. The pick-up head system 100, and particularly the housing 110, define the generally central fore-aft longitudinal axis of travel "L".

More specifically, the pick-up head system 100 comprises a housing 110 extending between a first end 111 and a second end 112 to define a width "$W_H$" (see FIG. 1K). Preferably the width "$W_H$" of the housing is greater than three-quarters of the width "$W_V$" of the surface cleaning vehicle 102, and also is preferably approximately the width "$W_V$" of the surface cleaning vehicle 102. It has been found that having the width "$W_H$" of the housing 110 approximately equal to the width "$W_V$" of the surface cleaning vehicle is very beneficial for purposes of full cleaning of the surface to be cleaned 104 and also for precluding damage to the outer ends 111,112 of the housing 110. Such damage can readily occur if the outer ends 111,112 of the housing 110 project laterally outwardly past the width of the surface cleaning vehicle 102.

The housing 110 extends substantially transversely to the generally central fore-aft longitudinal axis of travel "L". The housing 110 has a substantially hollow interior 119 and a suctioning bottom opening 114 defined by a bottom peripheral edge 109. The suctioning bottom opening 114 is open in fluid communication and debris transfer relation to the substantially hollow interior 119. Further, the housing 110 has a front wall 115, a back wall portion 116, interconnected by a roof portion 118. Dust and fine particulate on the surface to be cleaned 104 pass under the front peripheral edge portion 109*f* and are suctioned into the substantially hollow interior 119 of the housing 110.

The front wall 115 of the housing has a first sloped portion 115*a* and a second sloped portion 115*b* that are each sloped rearwardly and inwardly towards the debris receiving main inlet 142. The debris receiving main inlet 142 is disposed in the front wall 115 between the first sloped portion 115*a* and the second sloped portion 115*b*, in debris receiving relation with respect to a surface to be cleaned 104. Further, the housing 110 is substantially "V"-shaped and the debris receiving main inlet 142 is disposed at the vertex of the "V"-shaped front wall 115.

The pick-up head system 100 further comprises a first debris suctioning inlet 140*a* in the housing 110. The first debris suctioning inlet 140*a* is disposed adjacent the first end 111 of the housing 110 and is for suctioning debris into the housing 110. The suctioned debris might include larger debris such as bottles, cans, leaves, twigs, and so on, and might also include smaller debris such as dirt, dust, sand, and so on.

The pick-up head system 100 also comprises a debris receiving main inlet 142 in the front wall 115 of the housing 110 in debris receiving relation with respect to a surface to be cleaned 104, for receiving debris into the housing 110. There is also a door apparatus 150 operatively mounted at the debris receiving main inlet 142, as will be discussed in greater detail subsequently. Preferably, the sealed door apparatus 150 comprises a substantially sealed door apparatus.

The substantially rigid debris deflecting skirt 108 is disposed at the bottom peripheral edge 109 of the housing 110 for interfacing the housing 110 in substantially sealed relation with the surface to be cleaned 104 as the surface cleaning vehicle 102 moves along the surface to be cleaned 104. Furthermore, the substantially rigid debris deflecting skirt 108 is disposed on the housing 110 in debris deflecting relation, to thereby deflect debris across a surface to be cleaned 104.

Preferably, the substantially rigid debris deflecting skirt is also solid, and is non-curling and non-pliable, or in other words does not curl rearwardly at the bottom when debris is encountered, as prior art skirts must necessarily do. Also related to not curling rearwardly at the bottom when debris is encountered, the substantially rigid debris deflecting skirt is substantially horizontally oriented to help push and deflect debris. The substantially rigid debris deflecting skirt is also gapless, or in other words has no gaps in it for small debris to pass through.

The substantially rigid debris deflecting skirt 108 precludes the passage of almost all air (and contaminants therein, such as dust and other fine particulate matter and the like) from escaping out of the housing 110 in the event that a section of the housing 110 has a higher air pressure than the ambient surroundings, which can occur with recirculating air type pick-up head systems, if the seal with the surface to be cleaned is not present. A very small portion of air is suctioned between the substantially rigid debris deflecting skirt 108 and the surface to be cleaned 104 to preclude any dust and other fine particulate matter and the like from escaping from the housing 110, and also to suction in dust and other fine particulate matter and the like under the substantially rigid debris deflecting skirt 108 at the front wall 115, which may be created as the substantially rigid debris deflecting skirt 108 at the front wall 115 engages the surface to be cleaned 104.

Furthermore, the substantially rigid debris deflecting skirt 108 precludes the passage of larger debris, such as stones, bottles, cans, leaves, and the like, from passing under the front wall 115 as the housing 100 moves along the surface to be cleaned 104. Instead, the substantially rigid debris deflecting skirt 108 directs small debris, such as gravel, along the housing 110 to the debris receiving main inlet 142 at the sealed door apparatus 150. The front wall 115 of the housing directs larger debris to the debris receiving main inlet 142 at the sealed door apparatus 150 due to the right-to-left rearward slant of the housing 110.

Preferably, the substantially rigid debris deflecting skirt 108 is made from UHMW polyethylene or polyurethane, or any other suitable material, to promote sliding of the housing 110 along the surface to be cleaned 104, as opposed to riding over the debris, thereby breaking the "seal" of the substantially rigid debris deflecting skirt 108 with the surface to be cleaned 104. Preferably, there are vertical slots (not specifically shown) in the substantially rigid debris deflecting skirt 108 to allow for vertical adjustment (downward adjustment) of the substantially rigid debris deflecting skirt 108 with respect to the housing 110 as the substantially rigid debris deflecting skirt 108 wears. Suitable fasteners would extend through the vertical slots (not specifically shown) and threadibly engage co-operating threaded apertures in the housing 110. It is also contemplated that a downwardly sprung flap (not shown) could be included to make a seal with the surface to be cleaned 104. In the event that the substantially rigid debris deflecting skirt 108 temporarily does not "seal" with the surface to be cleaned 104, such as when the housing 110 travels over a pothole, or the like, or rides up slightly over a sewer grate, or the like, and simply doesn't have the deflection to seal properly because it is designed to be rigid as a plowing entity.

The debris outlet 120 is disposed generally centrally, in a lateral sense, in the housing 110, immediately rearwardly of the debris receiving main inlet 142, for permitting dust and debris to egress from the housing 110 into a hopper (not specifically shown). The debris outlet 120 is disposed towards the back wall portion 116 of the housing 110 generally centrally disposed between the first end 111 and the second end 112. The debris outlet 120 is connected in air flow delivery relation through a delivery duct 121 to a hopper for permitting dust and debris to egress from the housing 110 into the hopper. Preferably, the first debris suctioning inlet 140*a* has a cross-sectional area about one-half the cross-sectional area of the debris outlet 120.

The sealed door assembly 150 of the first preferred embodiment pick-up head system 100 comprises a door frame 145 that surrounds the debris receiving main inlet 142. Preferably, the door frame 145 has a first side plate 145*a* and a second side plate 145*b*, and an arcuate header portion 145*c* defining a center axis "C" disposed substantially horizontally and generally transversely to the fore-aft longitudinal axis of travel "L".

The sealed door assembly 150 of the first preferred embodiment pick-up head system 100 further comprises rotatable door assembly 146 that defines a substantially horizontally oriented central pivot axis "P" and an outer periphery 146*p*, and has a wherein the rotatable door assembly has a first side 146*a* and a second side 146*b*. The rotatable door assembly 146 is mounted on the housing 110 at the door frame 145. There is also an air flow barrier seal 147 operatively disposed in sealing relation between the rotatable door assembly 146 and the housing 110, and more specifically between the rotatable door assembly 146 and the door frame 145.

The rotatable door assembly 146 comprises at least a first door portion 146*a* and a second door portion 146*b*, and in the first preferred embodiment, as illustrated, also comprises a third door portion 146*c*, a fourth door portion 146*d*, a fifth door portion 146*e*, a sixth door portion 146*f*, a seventh door portion 146*g*, an eighth door portion 146*h*, and a ninth door portion 146*i* joined together at a substantially horizontally oriented central pivot axis "P" that is substantially transverse to the generally central fore-aft longitudinal axis of travel "L", and is collinear with the center axis "C" of the arcuate header portion 145*c*, and operatively mounted at the central pivot axis "P" in rotatable relation on the housing 110 at the debris receiving main inlet 142.

The air flow barrier seal 147 is operatively disposed between the rotatable door assembly 146 and the door frame 145 for sealing the rotatable door assembly 146 with respect to the door frame 145, to thereby substantially preclude ingression of air into the substantially hollow interior 119 of the housing 110 through the debris receiving main inlet 142, as the rotatable door assembly 146 rotates to permit debris to enter the substantially hollow interior 119 of the housing 110.

The first door portion 146*a* has a first side edge 148*a* and a second side edge 148*b* and an end edge 148*c* spanning between the first side edge 148*a* and the second side edge 148*b*. Similarly, each of the other door portions has a first side edge and a second side edge and an end edge spanning between the first side edge and the second side edge. In the first preferred embodiment, as illustrated, there are nine door portions 146*a* through 146*i*, each the same as the others. Preferably, the end edges are substantially straight to evenly and fully engage a surface to be cleaned 104 such as a street or a parking lot, or the like.

Preferably, the air flow barrier seal 147 comprises a sealing flap 147 disposed at the side edge of each of the first door portion 146*a* and the second door portion 146*b* for intermittently contacting a surface to be cleaned 104 in substantially sealed relation as the rotatable door assembly 146 rotates. Since the sealing flaps 147 will typically wear quite readily, the sealing flaps 147 are preferably removable and replaceable, typically by means of suitable threaded fasteners (not specifically shown). The sealing flaps 147 are made from rubber material, a rubber composite material, a synthetic rubber material, or a synthetic rubber composite material, or any other suitable material in order to engage the surface to be cleaned 104 in substantially sealed relation. Preferably, the removable and replaceable sealing flaps 147 have a plurality of vertically oriented slots (not specifically shown) therein for receiving fasteners (not specifically shown) there through, thereby permitting height adjustable mounting of the removable and replaceable sealing flaps 147.

The pick-up head system 100 further comprises a knife blade 70*k* mounted on an extension portion 70*e* of each of the door portions 146*a* through 146*i* (only one shown), namely the first door portion 146*a*, and the second door portion 146*b*, and so on. Each extension portion 70*e* projects substantially transversely from the door portions 146*a* through 146*i* substantially in the direction of rotation of the rotatable door assembly 146. The knife blades knife blade 70*k* are for cutting debris entering the housing 110 through the sealed door assembly 150. In use, as the surface cleaning vehicle 102 moves along the surface to be cleaned 104, the knife blades 70*k*, shred the received debris and thereby produces shredded debris.

In an alternative embodiment, it is contemplated that the sealed pick-up head system further comprises a knife blade mounted on the end edge of each door portion, instead of on the extension portion, for cutting debris entering the housing.

The sealed pick-head system 100 further comprises a selectively operable actuation means for causing the rotatable door assembly 146 to rotate. Preferably the selectively operable actuation means comprises a hydraulic motor 190. The speed of the hydraulic motor 190 can be controlled by the operator of the surface cleaning vehicle 102. Preferably, the rotatable door assembly 146 is rotated by the selectively operable actuation means 190 to have an outer circumferential speed substantially equal to the forward speed of the sealed pick-up head system 110 along a surface to be cleaned 104, in a front-to-back direction. In this manner, the wearing of the rubber sealing flaps 147 on the surface to be cleaned 104 is minimized.

In order to control the rotational speed of the rotatable door assembly 146, in the first preferred embodiment, as illustrated, a signal indicative of the speed of the vehicle and that is fed to the speedometer of the surface cleaning vehicle 102 is used by a control system (not specifically shown) that uses the signal to determine the speed of the mobile surface cleaning vehicle 102 traveling forwardly along the surface to be cleaned 104. The control system would govern the speed of the selectively operable actuation means, namely the hydraulic motor 190, accordingly. As a result, the relative speed of the rubber sealing flaps 147 with respect to the surface to be cleaned 104, as the mobile surface cleaning vehicle 102 travels forwardly along the surface to be cleaned, would be zero, or very close to zero, depending on the accuracy of the control system and the selectively operable actuation means 190.

In use, the rotatable door assembly 146 rotates forwardly at the top and rearwardly at the bottom, as indicated by arrows "A", such that the rearward speed of the rubber sealing flaps 147 and the doors 146*a* through 146*i* with respect to the housing is the same as the speed of the mobile surface cleaning vehicle 102 traveling forwardly along the surface to be cleaned 104.

Alternatively, the operator of the mobile surface cleaning vehicle 102 could set the rotational speed of the selectively operable actuation means 190 to rotate at any other desired speed. Rotating the selectively operable actuation means 190 more quickly such that the rubber sealing flaps 147 travel rearwardly with respect to the surface to be cleaned 104, as the mobile surface cleaning vehicle 102 travels forwardly along the surface to be cleaned 104, would help debris be pushed into the debris outlet 120. The control system could be used to keep the speed of the rubber sealing flaps 147 constant with respect to the surface to be cleaned 104.

In a first alternative embodiment, as shown in FIG. 1N, the rotatable door assembly 146$^A$ further comprises at least one surface engaging member 149$^A$, and as illustrated comprises a first surface engaging wheel 149*a*$^A$ disposed at the first side 146*a*$^A$ of the rotatable door assembly 146$^A$ and a second surface engaging wheel 149*b*$^A$ disposed at the second side 146*b*$^A$ of the rotatable door assembly 146$^A$. The first surface engaging wheel 149*a*$^A$ and a second surface engaging wheel 149*b*$^A$ are preferably readily removable and replaceable by means of threaded fasteners (not specifically shown). Such rolling engagement causes the rotatable door assembly 146$^A$ to rotate such that the outer periphery 146*p*$^A$ of the rotatable door assembly 146$^A$ has substantially a zero speed with respect to the surface being cleaned 104$^A$.

In use, the first surface engaging wheel 149*a*$^A$ and a second surface engaging wheel 149*b*$^A$ roll along the surface to be cleaned 104$^A$ and thereby carry the rotatable door assembly 146$^A$ along such that the rearward peripheral speed of the rotatable door assembly 146$^A$ matches the forward speed of the surface cleaning vehicle. Accordingly, the speed of the rubber sealing flaps 147$^A$ along the surface being cleaned is zero.

As can be readily seen in the figures, the rotatable door assembly 146, the door frame 145, the sealing flaps 147, and the selectively operable actuation means 190 are connected in vertically movable relation to the housing 110 for movement between a lowered surface engaging position and a raised debris passing position. The rotatable door assembly 146, the door frame 145, the sealing flaps 147, and the selectively operable actuation means 190 form a raisable and lowerable sealed door assembly, as indicated by the general reference 150, that is mounted in hinged relation on the housing 110 by a suitable sealed hinge 143. Alternatively, any other suitable means could be used, such as a pair of left and right opposed pins engaged in co-operating ball bearing mechanisms. A pliable material, possibly in bellows form, could be used to maintain a seal between the door frame 145 and the housing 110, as necessary.

The sealed door assembly 150 is disposed immediately forwardly of the delivery duct 121. The sealed door assembly 150 is moved between its lowered position and its raised position by means of a hydraulic cylinder 144*hc*. The hydraulic cylinder 144*hc* is operatively interconnected between a mounting bracket 144*b* at the top of the sealed door assembly 150 and a mounting bracket 121*b* extending outwardly from the delivery duct 121.

The hydraulic drive motor 190 is mounted on the top of the rotatable door assembly 150 via a chain drive 144*c*. The chain drive 144*c* is covered by a small generally vertically oriented housing 144*h* in order to generally preclude dust and other contaminants from reaching the chain drive 144*c*, and also to preclude the escape of air and dust from the housing 110.

A rubber gasket type of material, or the like, is disposed at one or both of the sealed door assembly 150 and the opening of the debris receiving main inlet 142 of the housing 110, in order to provide a seal between the sealed door assembly 150 and the housing 110 when the sealed door assembly 150 is in its lowered surface engaging position.

Alternatively, the sealed door assembly 150 could be mounted in vertically sliding relation on the housing 110 by means of a plurality of parallel rails that are oriented either generally vertically, or even at an angle to vertically.

In the lowered surface engaging position, the rotatable door assembly 146 would engage the surface to be cleaned as described above. In the raised debris passing position, the rotatable door assembly 146 would be disposed in spaced relation from the surface to be cleaned, thereby allowing large debris to readily enter the housing 110, such as debris that might be too large to fit through the door frame 145 with the rotatable door assembly 146 in normal operation, or excessive amounts of large debris that need to be permitted into the housing quickly. In order to minimize the amount of time that the housing 110 might not be in a reduced air pressure situation, air cylinders could be used to quickly move the rotatable door assembly 146, the door frame 145, the sealing flaps 147, and the selectively operable actuation means 190 between the lowered surface engaging position and the raised debris passing position.

There is also a first debris suctioning inlet 140*a* in the housing 110 disposed adjacent the first end 111 of the housing 110, preferably at the first end 111 of the housing 110, for suctioning dust and debris into the housing 110. There is also a second debris suctioning inlet 140*b* in the housing 110 disposed adjacent the second end 112 of the housing 110, preferably at the second end 112 of the housing 110, for suctioning dust and debris into the housing 110. Both the first debris suctioning inlet 140*a* and the second debris suctioning inlet 140*b* are disposed on opposite sides of the fore-aft central longitudinal axis "L" one from the other, and face laterally away from the fore-aft central longitudinal axis "L". Further, the first debris suctioning inlet 140*a* and the second debris suctioning inlet 140*b* are disposed at a maximum distance "M" (see FIG. 1K) along the housing 110 from the debris outlet 120, which is disposed generally centrally in the housing 110, in a lateral sense. The various inventive aspects of the present invention, specifically the first preferred embodiment of the present invention, will now be discussed mostly with reference to the first debris suctioning inlet 140*a*, in order to avoid unnecessary duplication. The same discussion also generally applies to the second debris suctioning inlet 140*b*.

Furthermore, the first debris suctioning inlet 140*a* defines an external debris suctioning space 131 immediately beyond the first debris suctioning inlet 140*a* on the surface to be cleaned 104, whereat debris disposed externally to the housing 110 and adjacent to the first debris suctioning inlet 140*a* can readily be suctioned into the housing 110, and wherein the external debris suctioning space 131 is substantially unobstructed.

As can be seen in the figures, the first debris suctioning inlet 140*a* is preferably oriented forwardly, and more preferably oriented outwardly and forwardly, to permit the first debris suctioning inlet 140*a* to receive debris as the pick-up head system 100 travels along a surface to be cleaned 104.

As can be seen in the figures, the back wall portion 116 extends outwardly away from the fore-aft axis "L" further than the front wall 115, thereby creating a laterally and forwardly facing first debris suctioning inlet 140*a*.

There is also a substantially unobstructed debris passage 130 within the housing 110 extending from the first debris suctioning inlet 140*a* to the debris outlet 120. The debris outlet 120 is for receiving dust and debris from the debris passage 130 and permitting dust and debris to egress from the housing 110 into the hopper. The debris passage 130 is disposed within the housing in debris delivery relation with respect to the debris outlet 120.

Preferably, the cross-sectional area from front-to-back and top-to-bottom of the debris passage 130 in the housing 110 from the first debris suctioning inlet 140*a* to the debris outlet 120 is substantially constant. Moreover, the height of the debris passage 130 is constant and the width the debris passage 130 is constant.

Debris is suctioned into the substantially hollow interior 119 of the housing 110, and along the substantially unobstructed debris passage 130 through the first debris suctioning inlet 140*a*. Furthermore, very small debris, such as dust, is suctioned into the substantially unobstructed debris passage 130 through the suctioning bottom opening 114 of the housing 110.

In the first preferred embodiment as illustrated, the pick-up head system 100 further comprises a debris receiving main inlet 142 in the front wall 115 of the housing 110, generally centrally disposed left-to-right in the housing 110. Any debris that is pushed along the front wall 115 of the housing 110 from the first end (the right end) will reach the debris receiving main inlet 142. A sealed door apparatus, as indicated by the general reference numeral 150, is operatively mounted at the debris receiving main inlet 142 in the front wall 115 of the housing 110. The sealed door apparatus 150 permits the passage of debris there through, while precluding air and dust from escaping from the housing 110. The sealed door apparatus 150 allows the ingress of debris without sacrificing a properly reduced air pressure within the housing 110.

The debris outlet 120 in the housing 110 permits dust and debris, including the shredded debris to be suctioned from the substantially hollow interior 119 of the housing 110 into the hopper. It will also be noted that the debris outlet 120 is generally centrally disposed in the back of the housing 110, so as to be generally laterally aligned with the debris receiving main inlet 142, and therefore with the sealed door apparatus 150, so as to directly receive debris therefrom.

In the above described manner, since debris is shredded as it enters into the substantially hollow interior 119 of the housing 110, the housing 110 can be lower in height. Accordingly, the housing 110 can have a smaller cross-section than prior art housings, and the debris outlet 120 and the delivery duct 121 can have a smaller cross-section, thus helping to maximize the efficiency and effectiveness of the first preferred embodiment debris shredding pick-up head system 100.

A main fan 40 having an air inlet 40*i* and an air outlet 40*o* is mountable on a surface cleaning vehicle 102, such as a street sweeping vehicle. The air inlet 40*i* is connected in air flow receiving relation to the hopper. The air outlet 40*o* is connected in air flow delivery relation to the debris passage 130, for providing a flow of air for ingress into the debris passage 130.

There is also an air supply passage 180 within the housing 110. The air supply passage 180 has an air inlet 181 adjacent the debris outlet 120 and a first air outlet 182*a* adjacent the first end 111 of the housing 110 and a second air outlet 182*b* adjacent the second end 112 of the housing 110. The housing 110 is substantially "V"-shaped and the debris outlet 120 is disposed adjacent the vertex of the "V"-shaped housing 110. The first air outlet 182*a* is defined by a first curved wall portion 183*a* that directs the flow of air and debris from air supply passage 180 to the debris passage 130 in the proper direction to flow to the debris outlet 120. Similarly, the second air outlet 182*b* is defined by a second curved wall portion 183*b* that directs the flow of air and debris from air supply passage 180 to the debris passage 130 in the proper direction to flow to the debris outlet 120.

It is important that the first air outlet 182*a* of the air supply passage 180 is disposed in spaced relation from the debris outlet 120 so that the air emanating from the first air outlet 182*a* does not merely get suctioned into the debris outlet 120 without being effective in carrying dust and debris along the debris passage 130.

The air inlet 181 is connectable to a source of high speed air flow, such as the main fan 40 of the surface cleaning vehicle 102. The main fan 40 has an inlet 40*i* connected in air flow receiving relation to the debris hopper (not specifically shown), and an outlet 40*o* connected in air delivery relation to the air inlet 181 of the air supply passage 180. The air supply passage 180 provides a flow of high speed air to the debris passage 130 at the first end 111 of the housing 110 and at the second end 112 of the housing 110 for cleaning the surface to be cleaned 104 substantially evenly from the first end 111 of the housing 110 to the debris outlet 120 and from second end 112 of the housing 110 to the debris outlet 120.

In the first preferred embodiment as illustrated, the air supply passage 180 is disposed at the back of the housing 110, with the air supply passage 180 being defined by the housing 110, and a dividing portion 110*d* of the housing 110 separating the air supply passage 180 and the debris passage 130. The air supply passage 180 is open along its length at the bottom of the housing 110 to permit the flow of high speed air to impact the surface to be cleaned 104 substantially along the entire length of the air supply passage 180. This provides a final cleaning of the surface to be cleaned 104.

The pick-up head system 100 further comprises as part of the substantially rigid debris deflecting skirt 108, an interior skirt portion 108*i*, disposed at the bottom edge of the dividing portion 110*d* of the housing 110 for interfacing the dividing portion 110*d* of the housing 110 in substantially sealed relation with the surface to be cleaned 104 as the surface cleaning vehicle 102 moves along the surface to be cleaned 104. In some instances, it may be desirable for the interior skirt portion 108*i* to be raised slightly above the surface to be cleaned 104 in order to permit a very small amount of air flow thereunder, to enter the debris passage 130. The interior skirt portion 108*i* preferably comprises a polyethylene type of material, such as ultra-high molecular weight polyethylene, or any other suitable type of material.

In use, the pick-up head system 100 is carried forwardly along the surface to be cleaned 104 by the surface cleaning vehicle 102 such that the substantially rigid debris deflecting skirt 108 disposed at the bottom of the peripheral edge 109 of the housing 110 and at the bottom edge of the dividing portion 110*d* of the housing 110 generally remain in substantially sealed relation with the surface to be cleaned 104. The substantially rigid debris deflecting skirt 108 pushes small debris along itself laterally towards the sealed door apparatus 150 where the debris is taken into the housing 110 through the debris receiving main inlet 142. A substantial and forceful stream of air is suctioned into the substantially hollow interior 119 of the housing 110, specifically the debris passage 130, through the first debris suctioning inlet 140*a* at the first end 111 of the housing 110, where it enters the rightmost end of the debris passage 130 and travels to the debris outlet 120.

Another forceful but typically lower volume stream of air is blown into the air inlet 181 of the air supply passage 180 whereat the flow of air impacts along the surface to be cleaned 104 thereby removing any remaining dust and other fine particulates from the surface to be cleaned 104.

Most of the flow of air exits from the air supply passage 180 at its first air outlet 182*a* and re-enters the housing 110 at the first debris suctioning inlet 140*a* to join the ambient air that is being suctioned into the first debris suctioning inlet 140*a*. In this manner, only the amount of ambient air that newly enters the housing 110, which can be adjusted to be a small volumetric amount per unit time, needs to be filtered by the air filtration system of the service cleaning vehicle 102.

Furthermore, a small portion of the air flow in the air supply passage 180 exits the air supply passage 180 forwardly under the interior skirt portion 108*i* on the bottom edge of the dividing portion 110*d* of the housing 110. If the dividing portion 110*d* of the housing 110 is in its low position very close to the surface to be cleaned 104, the cross-sectional area that the air flows through is correspondingly small, thereby causing the air to forcefully escape under the dividing portion 110*d* of the housing 110. Accordingly, the air forcefully impinges on the surface to be cleaned 104, thereby removing virtually all remaining dust and fine particulate matter. If the dividing portion 110*d* is raised slightly higher above the surface to be cleaned 104, the air will less forcefully impinge on the surface to be cleaned 104.

In another aspect, the present invention comprises a self-propelled surface cleaning system comprising the main vehicle 102 having a width "$W_V$". The pick-up head 105 is operatively mounted on the main vehicle 102. The pick-up head 105 includes the housing 110 extending between the first end 111 and a second end 112 to define a width "$W_H$" and extending substantially transversely to the fore-aft axis of travel "L". The width "$W_H$" of the housing 110 of the pick-up head 105 is substantially the same as the width "$W_V$" of the main vehicle 102.

The housing 110 includes the substantially hollow interior 119 and the suctioning bottom opening 114 defined by the bottom peripheral edge 109 and is open in fluid communication and debris transfer relation to the substantially hollow interior 119. The first debris suctioning inlet 140*a* and the second debris suctioning inlet 140*b* are in the housing 110, disposed adjacent the first end 111 and the second end 112, respectively, of the housing 110, for suctioning debris 101 into the housing 110. The debris outlet 120 in the housing 110 is open in fluid communication and debris transfer relation to the substantially hollow interior 119 of the housing 110. Debris 101 is suctioned into the substantially hollow interior 119 of the housing 110 through the debris suctioning inlets 140*a*, 140*b*, and is discharged from the housing 110 through the debris outlet 120.

Figure 2A:
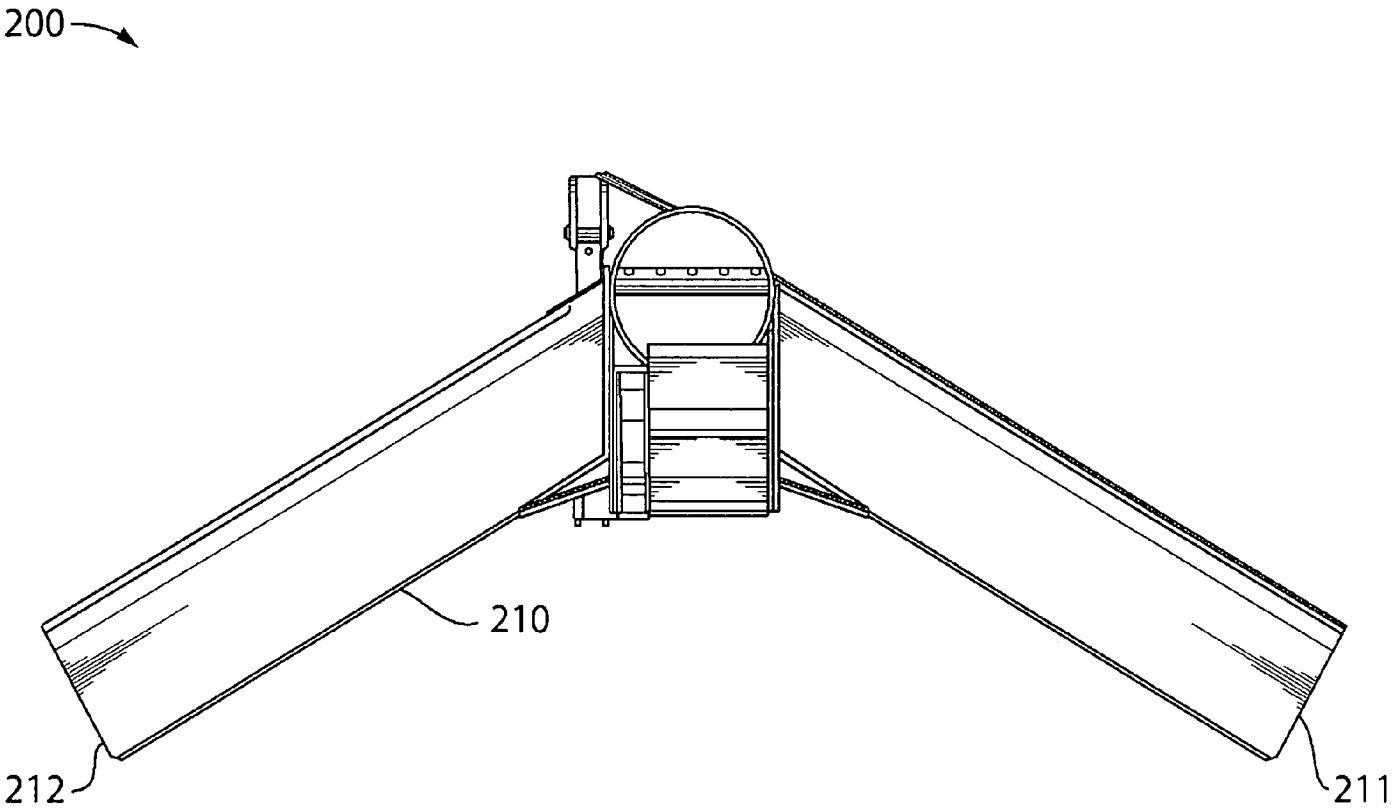
FIG. 2A is a bottom plan view of the second preferred embodiment pick-up head system according to the present invention.

Reference will now be made to FIG. 2A, which shows a second preferred embodiment of the pick-up head system according to the present invention, as indicated by reference numeral 200. The second preferred embodiment pick-up head system 200 is similar to the first preferred embodiment pick-up head system 100, except that the housing 210 has a closed first end 211 a closed second end 212.

Figure 3A:
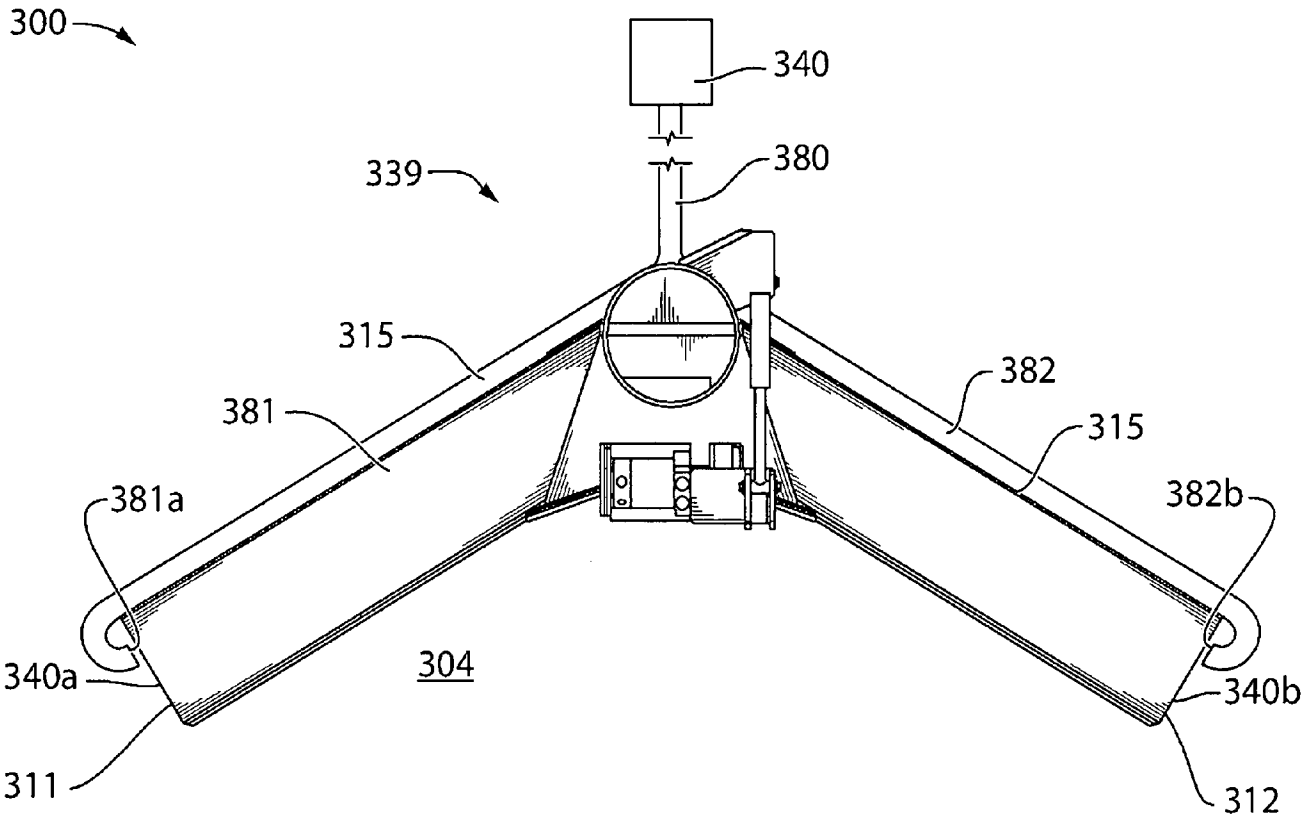
FIG. 3A is a top plan view of the third preferred embodiment pick-up head system according to the present invention.

Reference will now be made to FIG. 3A, which shows a third preferred embodiment of the pick-up head system according to the present invention, as indicated by reference numeral 300. The third preferred embodiment pick-up head system 300 is similar to the first preferred embodiment pick-up head system 100, except that in the third preferred embodiment pick-up head system 300 there is an air flow apparatus 339 comprising a first air delivery duct 381 and a second air delivery duct 382, each fed by a larger diameter single air delivery duct 380, which receives a forceful flow of air from the main fan 340. The first air delivery duct 381 and the second air delivery duct 382 are each secured to the rear wall 315 of the housing 310 by any suitable means. The first air delivery duct 381 curves forwardly at its outer end around the first end 311 of the housing 310, and terminates just outside the first debris suctioning inlet 340*a* such that the first air outlet 382*a* is oriented generally downwardly and forwardly to thereby direct a blast of air at the first debris suctioning inlet 340*a* and at the surface to be cleaned 304, and into the first debris suctioning inlet 340*a*. Similarly, the second air delivery duct 382 curves forwardly at its outer end around the second end 312 of the housing 310, and terminates just outside the second debris suctioning inlet 340*b* such that the second air outlet 382*b* is oriented generally downwardly and forwardly to thereby direct a blast of air at the second debris suctioning inlet 340*b* and at the surface to be cleaned 304, and into the second debris suctioning inlet 340*b*.

Figure 4A:
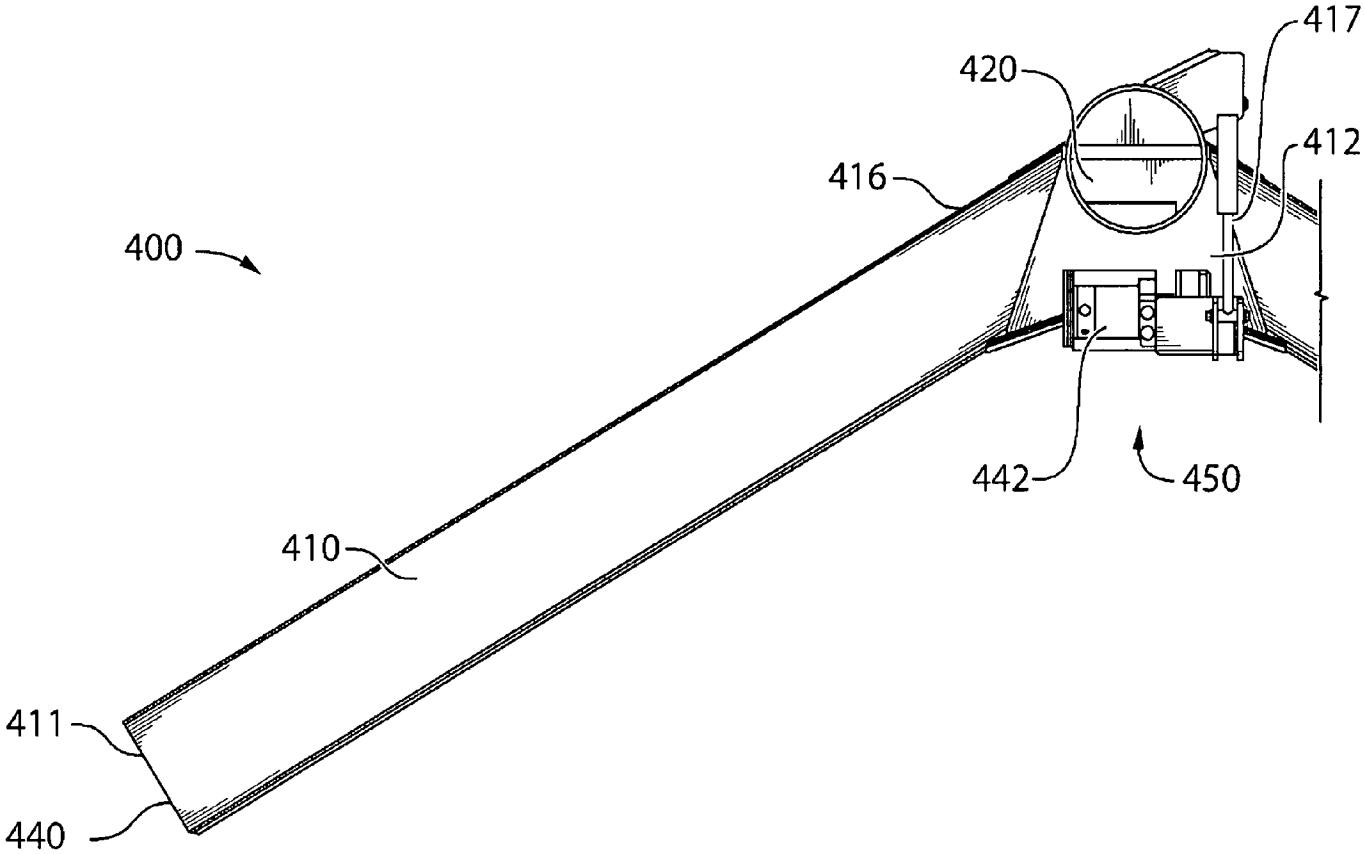
FIG. 4A is a top plan view of the fourth preferred embodiment pick-up head system according to the present invention.

Reference will now be made to FIG. 4A, which shows a fourth preferred embodiment of the pick-up head system according to the present invention, as indicated by reference numeral 400. The fourth preferred embodiment pick-up head system 400 is similar to the first preferred embodiment pick-up head system 100, except that the housing is substantially straight and is slanted rearwardly from the first debris suctioning inlet 440 to a left end wall portion 417 disposed at the second end 412 of the housing 410. There is only one debris suctioning inlet 440 disposed at the first end 411 of the housing 410. Further, the debris outlet 420 is disposed towards the second end 412 of the housing 410. The debris receiving main inlet 442 and the sealed door apparatus 450 are also disposed adjacent the second end 412 of the housing 410. The debris outlet 420 is disposed adjacent the back wall portion 416 of the housing 410 adjacent the second end 412 of the housing 410.

Figure 5A:
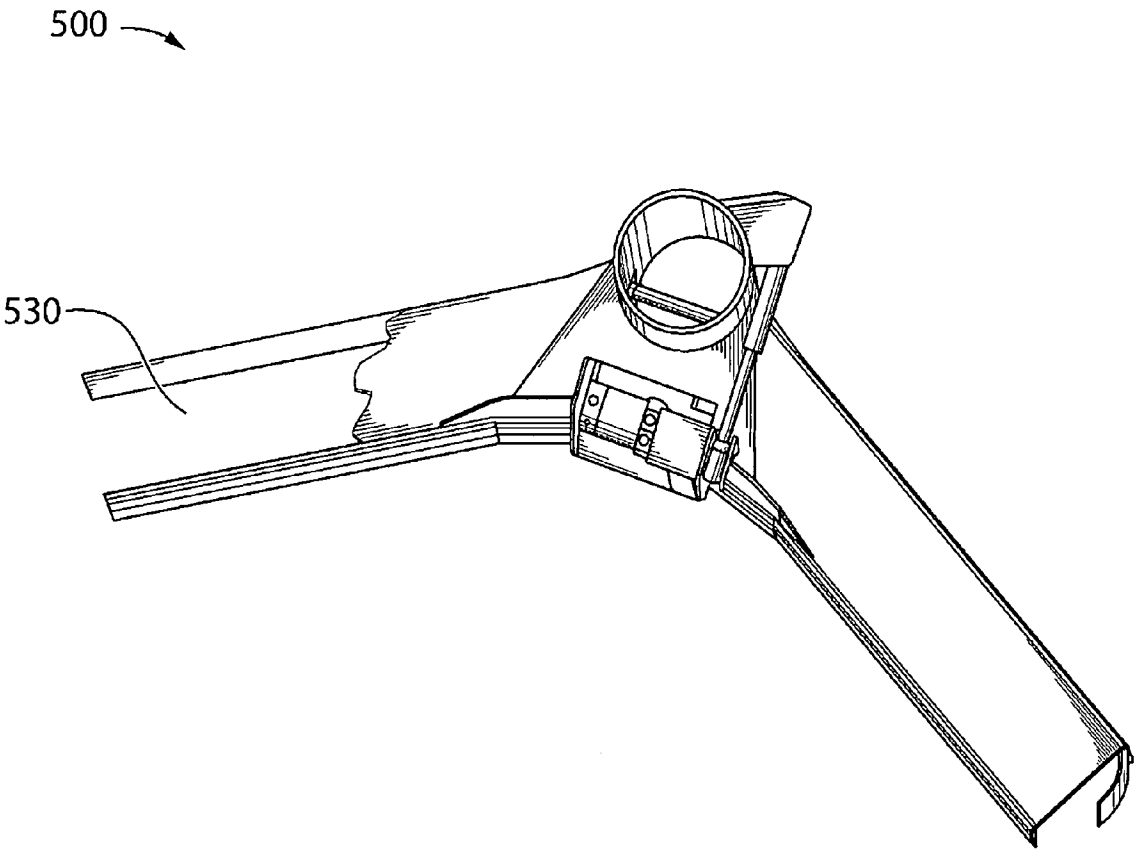
FIG. 5A is a partially cut-away top perspective view from above of the fifth preferred embodiment pick-up head system according to the present invention.

Reference will now be made to FIG. 5A, which shows a fifth preferred embodiment of the pick-up head system according to the present invention, as indicated by reference numeral 500. The fifth preferred embodiment pick-up head system 500 is similar to the first preferred embodiment pick-up head system 100, except that in the fifth preferred embodiment pick-up head system 500 there is no return of air from the main fan into the housing. Instead, the fifth preferred embodiment pick-up head system 500 is part of a vacuum type system. It can be seen that the debris passage 530 is wide open (no air supply passage) and there is no external air supply conduit.

Figure 6A:
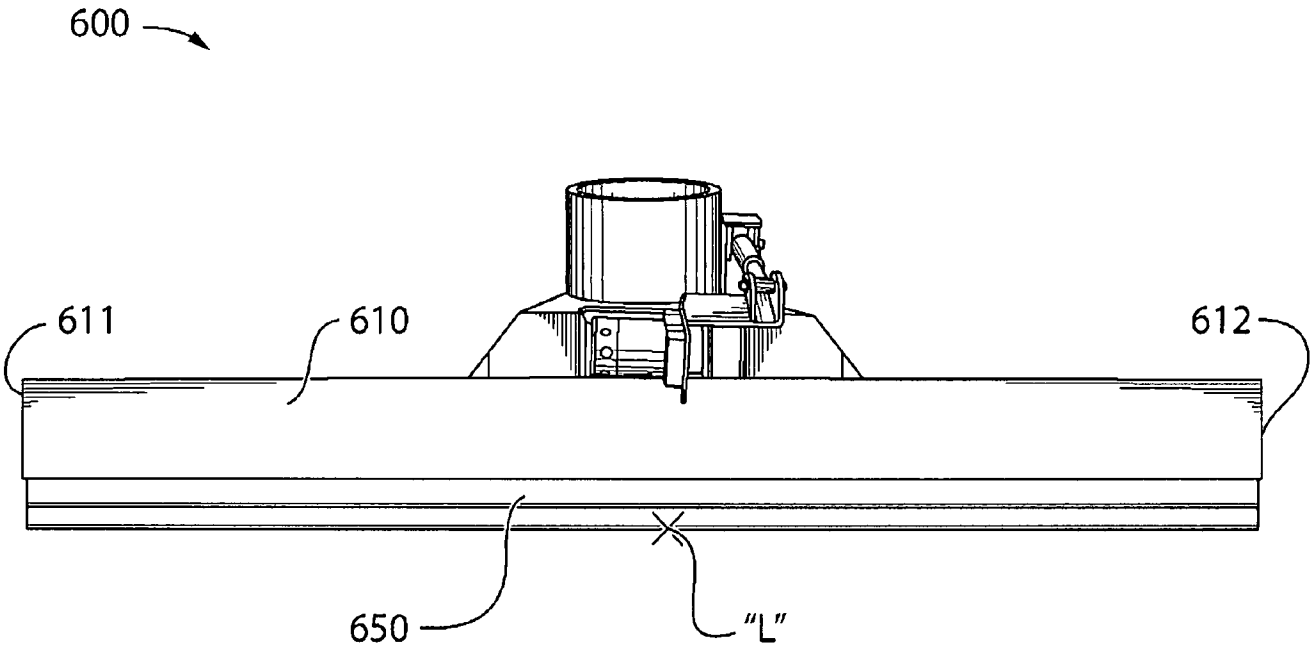
FIG. 6A is a front elevational view of the sixth preferred embodiment pick-up head system according to the present invention; and, FIG. 7A is a partially cut-away side elevational view of the seventh preferred embodiment pick-up head system according to the present invention.

Reference will now be made to FIG. 6A, which shows a sixth preferred embodiment of the pick-up head system according to the present invention, as indicated by reference numeral 600. The sixth preferred embodiment pick-up head system 600 is similar to the first preferred embodiment pick-up head system 100, except that in the sixth preferred embodiment pick-up head system 600 the housing 610 extends between a first end 611 and a second end 612, and extends substantially transversely to the fore-aft axis "L" of the housing 610, and the rotatable door assembly 650 extends substantially the entire distance between the first end 611 and the second end 612 of the housing 610.

Figure 7A:
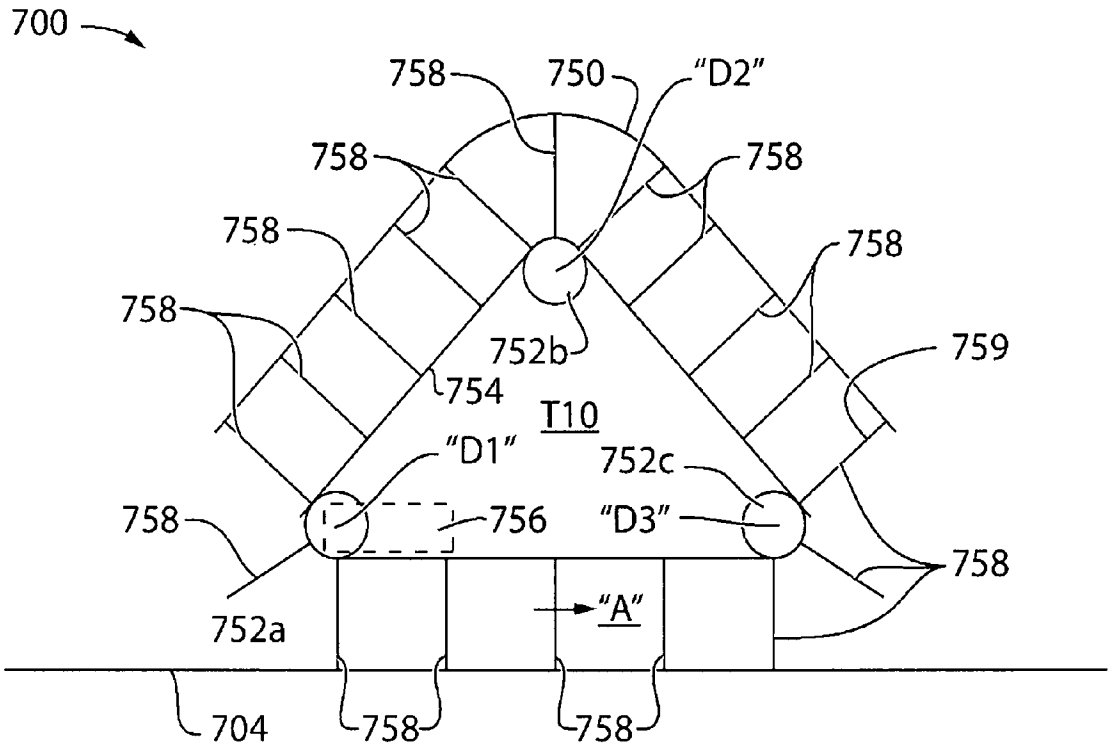

Reference will now be made to FIG. 7A, which shows a seventh preferred embodiment of the pick-up head system according to the present invention, as indicated by reference numeral 700. The seventh preferred embodiment pick-up head system 700 is similar to the first preferred embodiment pick-up head system 100, except that in the seventh preferred embodiment pick-up head system 700 the substantially sealed door apparatus 750 comprises a first rotatable support mechanism 752*a* rotatable about a first door axis "D1", a second rotatable support mechanism 752*b* rotatable about a second door axis "D2", and a third rotatable support mechanism 752*c* rotatable about a third door axis "D3". A flexible ring-shaped belt 754 is mounted peripherally around the first rotatable support mechanism 752*a*, the second rotatable support mechanism 752*b*, and the third rotatable support mechanism 752*c*, for peripheral movement of the flexible ring-shaped belt 754 peripherally about the first rotatable support mechanism 752*a*, the second rotatable support mechanism 752*b*, and the third rotatable support mechanism 752*c*, in a direction as indicated by arrow "A".

A drive mechanism 756 operatively engages the flexible ring-shaped belt 754 in driving relation, via the first rotatable support mechanism 752*a*, to thereby drive the flexible ring-shaped belt 754 through its peripheral movement. The flexible ring-shaped belt 754 is substantially solid to thereby preclude the flow of air therethrough. A plurality of doors 758 are mounted in outwardly extending relation on the flexible ring-shaped belt 754 such that each door can contact a surface being cleaned 704. An air flow barrier 759 is operatively disposed between the plurality of doors 758 and the housing 710 to substantially preclude the passage of air and small debris between the plurality of doors 758 and the housing 710.

As can be understood from the above description and from the accompanying drawings, the present invention provides a full-width dustless pick-up head system, full-width dustless pick-up head system wherein the effective size of the debris receiving opening whereat the substantially sealed door apparatus is mounted, can be more than about half the width of the pick-up head, and wherein the effective size of the debris receiving opening whereat the substantially sealed door apparatus is mounted, can be the full width of the pick-up head, all of which features are unknown in the prior art.

Other variations of the above principles will be apparent to those who are knowledgeable in the field of the invention, and such variations are considered to be within the scope of the present invention. Further, other modifications and alterations may be used in the design and manufacture of the pick-up head system of the present invention without departing from the spirit and scope of the accompanying claims.

I claim:

1. A pick-up head system for use with a surface cleaning vehicle having a fore-aft axis of travel, said pick-up head system comprising:

a housing having an interior and a suctioning bottom opening defined by a bottom peripheral edge and open in fluid communication and debris transfer relation to said interior, and defining a fore-aft axis;

a debris receiving main inlet in said housing, disposed in debris receiving relation with respect to a surface being cleaned, for receiving debris to said housing, and disposed in debris transfer relation to said interior of said housing for receiving debris to said housing;

a rotatable door assembly mounted on said housing at said debris receiving main inlet for rotation about a substantially horizontally oriented door pivot axis, for controlling the passage of debris through said debris receiving main inlet;

an air flow barrier operatively disposed between said rotatable door assembly and said housing to substantially preclude the passage of air and small debris between said rotatable door assembly and said housing; and, a debris outlet in said housing;

wherein, in use, as said rotatable door assembly rotates about said horizontally oriented door pivot axis to thereby permit debris to enter said housing through said debris receiving main inlet, said air flow barrier substantially precludes the passage of air and small debris between said rotatable door assembly and said housing.

2. The pick-up head system of claim 1, wherein said debris receiving main inlet and said rotatable door assembly are disposed in the front of said housing.

3. The pick-up head system of claim 2, wherein said housing having a front wall, and wherein said debris receiving main inlet is disposed in the front wall of said housing.

4. The pick-up head system of claim 3, further comprising a first debris deflecting part and a second debris deflecting part, and wherein said debris receiving main inlet is disposed in said housing between said first debris deflecting part and a second debris deflection part.

5. The pick-up head system of claim 4, wherein said first debris deflecting part and a second debris deflection part are part of said front wall of said housing.

6. The pick-up head system of claim 1, wherein said air flow barrier comprises at least one flexible sealing strip.

7. The pick-up head system of claim 1, wherein said rotatable door assembly comprises at least a first door portion and a second door portion joined together at said substantially horizontally oriented door pivot axis.

8. The pick-up head system of claim 7, further comprising a door frame mounted on said housing in surrounding relation to said debris receiving main inlet, and wherein said rotatable door assembly is mounted to be disposed within said door frame.

9. The pick-up head system of claim 7, wherein said door frame further comprising an arcuate header portion.

10. The pick-up head system of claim 9, wherein said substantially horizontally oriented door pivot axis is collinear with said center axis of said arcuate header portion.

11. The pick-up head system of claim 7, wherein said first door portion and said second door portion each have a first side edge and a second side edge and an end edge spanning between said first side edge and said second side edge.

12. The pick-up head system of claim 11, wherein said end edges are substantially straight along their lengths.

13. The pick-up head system of claim 11, further comprising a sealing flap disposed at said side edge of each of said first door portion and said second door portion for intermittently contacting a surface to be cleaned in substantially sealed relation as said rotatable door assembly rotates.

14. The pick-up head system of claim 13, wherein said sealing flaps are removable and replaceable.

15. The pick-up head system of claim 13, wherein said sealing flaps are made from a rubber material, a rubber composite material, a synthetic rubber material, or a synthetic rubber composite material.

16. The pick-up head system of claim 11, further comprising at least one knife blade mounted on said rotatable door assembly.

17. The pick-up head system of claim 16, wherein each said knife blade is mounted on one of said first and second door portions.

18. The pick-up head system of claim 17, wherein each said knife blade is mounted on an extension portion of said first and second door portions.

19. The pick-up head system of claim 18, wherein each extension portion projects substantially transversely from the door portion substantially in the direction of rotation of said rotatable door assembly.

20. The pick-up head system of claim 1, further comprising a selectively operable actuation mechanism for causing said rotatable door assembly to rotate.

21. The pick-up head system of claim 20, wherein said selectively operable actuation mechanism comprises a hydraulic motor.

22. The pick-up head system of claim 20, wherein said rotatable door assembly is rotated by said selectively operable actuation mechanism to have an outer circumferential speed substantially equal to the forward speed of said sealed pick-up head along a surface to be cleaned, in a front-to-back direction.

23. The pick-up head system of claim 1, wherein said door frame has a left side plate and a right side plate, and an arcuate header portion defining a center axis disposed substantially horizontally and generally transversely to said fore-aft axis of said housing.

24. The pick-up head system of claim 1, wherein said debris outlet is disposed immediately rearwardly of said debris receiving main inlet.

25. The pick-up head system of claim 1, further comprising a substantially rigid debris deflecting skirt disposed at said bottom peripheral edge of said housing for interfacing said housing in substantially sealed relation with the surface to be cleaned as the surface cleaning vehicle moves along said surface to be cleaned.

26. The pick-up head system of claim 25, wherein said substantially rigid debris deflecting skirt is solid.

27. The pick-up head system of claim 25, wherein said substantially rigid debris deflecting skirt is gapless in that it has no gaps in it for small debris to pass through.

28. The pick-up head system of claim 25, wherein said substantially rigid debris deflecting skirt is non-curling.

29. The pick-up head system of claim 25, wherein said substantially rigid debris deflecting skirt is non-pliable.

30. The pick-up head system of claim 25, wherein said substantially rigid debris deflecting skirt is substantially horizontally oriented.

31. The pick-up head system of claim 25, wherein said substantially rigid debris deflecting skirt is disposed on said housing in debris deflecting relation, to thereby deflect debris across a surface being cleaned.

32. The pick-up head system of claim 1, further comprising a debris suctioning inlet in said housing disposed adjacent said first end of said housing for suctioning dust and debris into said housing.

33. The pick-up head system of claim 2, wherein said housing extends between a first end and a second end and extends substantially transversely to said fore-aft axis of said housing, and wherein said rotatable door assembly extends substantially the entire distance between said first end and said second end of said housing.

34. The pick-up head system of claim 2, wherein said housing extends between a first end and a second end and extends substantially transversely to said fore-aft axis of said housing, wherein said rotatable door assembly is a first rotatable door assembly, and further comprising a second rotatable door assembly, and wherein said first rotatable door assembly and said second rotatable door assembly together extend substantially the entire distance between said first end and said second end of said housing.

35. A sealed door apparatus for use with a dustless pick-up head on a surface cleaning vehicle, said sealed door apparatus comprising:

a door frame surrounding said debris receiving main inlet;

a rotatable door assembly mounted on said housing at said door frame for rotation about a substantially horizontally oriented door pivot axis; and, an air flow barrier operatively disposed between said rotatable door assembly and said door frame to substantially preclude the passage of air and small debris between said rotatable door assembly and said door frame.

* * * * *